US005810301A

United States Patent [19]

McGrath et al.

[11] Patent Number: 5,810,301

[45] Date of Patent: Sep. 22, 1998

[54] UPPER TORSO SUPPORT FOR A WORKSTATION

[76] Inventors: Michael McGrath, 415 Summerhill Ter., Alpine, Calif. 91901; Joseph McGrath, 6841 Xana Way, Carlsbad, Calif. 92009; Josephine McGrath, 415 Summerhill Ter., Alpine, Calif. 91901

[21] Appl. No.: 486,335

[22] Filed: Jun. 7, 1995

Related U.S. Application Data

[63] Continuation-in-part of Ser. No. 309,119, Nov. 8, 1994, Pat. No. 5,605,311.

[51] Int. Cl.[6] ..... F16M 11/26; A47B 5/06

[52] U.S. Cl. ..... 248/118; 108/152; 248/188.5; 248/918

[58] Field of Search ..... 248/918, 118, 248/118.1, 118.3, 118.5, 157, 188.5, 364, 429, 500, 289.11; 108/152; 297/172, 411.21

[56] References Cited

U.S. PATENT DOCUMENTS

| | | | |
|---|---|---|---|
| 766,484 | 8/1904 | Armstrong | 248/118 |
| 1,737,350 | 11/1929 | Balcer . | |
| 2,113,882 | 4/1938 | Galt . | |
| 2,759,525 | 8/1956 | Ries . | |
| 2,773,542 | 12/1956 | Chasin . | |
| 2,903,714 | 9/1959 | Grondona . | |
| 2,950,890 | 8/1960 | Hough, Jr. . | |
| 3,741,514 | 6/1973 | Snurr . | |
| 4,621,781 | 11/1986 | Springer . | |
| 4,834,357 | 5/1989 | Bodenmiller . | |
| 4,884,842 | 12/1989 | Finkelstein . | |
| 4,894,871 | 1/1990 | Schmerler . | |
| 5,056,743 | 10/1991 | Zwar et al. . | |
| 5,072,905 | 12/1991 | Hyatt . | |
| 5,074,501 | 12/1991 | Hölttä . | |
| 5,104,073 | 4/1992 | VanBeek et al. . | |
| 5,108,057 | 4/1992 | Dandy, III et al. . | |
| 5,135,190 | 8/1992 | Wilson . | |
| 5,158,256 | 10/1992 | Gross . | |
| 5,161,760 | 11/1992 | Terbrack . | |
| 5,174,223 | 12/1992 | Nagy et al. . | |
| 5,195,705 | 3/1993 | Kline et al. . | |
| 5,209,452 | 5/1993 | Goldberg . | |
| 5,215,282 | 6/1993 | Bonutti . | |
| 5,224,429 | 7/1993 | Borgman et al. . | |
| 5,265,835 | 11/1993 | Nash . | |
| 5,281,001 | 1/1994 | Bergsten et al. . | |
| 5,342,006 | 8/1994 | Tice et al. . | |
| 5,351,897 | 10/1994 | Martin . | |
| 5,370,346 | 12/1994 | Long . | |
| 5,398,896 | 3/1995 | Terbrack . | |
| 5,542,746 | 8/1996 | Bujaryn | 297/172 |

OTHER PUBLICATIONS

Ignatius, Ellen "The High Cost of Keyboard Injuries", PC World, Mar. 1994, p. 45.

Feder, Barnaby J. "A Spreading Pain, and Cries for Justice", New York Times Business Section, Jun. 5, 1994.

ARMx® Product Flyer.

I9600 Industries Choice Rest™ Advertisement.

DataARm/Wrist Trolley/Keyboard Platform Advertisements.

Articulating Arm Support Advertisement.

Power Wheels, Model 16 Advertisement.

ARM*® Product Price List, MyoNetics® Inc.

*Primary Examiner*—Michael Safavi

*Attorney, Agent, or Firm*—Knobbe, Martens, Olson & Bear, LLP

[57] ABSTRACT

An adjustable, sturdy upper body support assembly for keyboard operators includes a pair of adjustable armrests mounted on a rigid frame which can be incorporated into a standalone system or into a workstation system. In one embodiment, the support assembly is positioned adjacent and partially underneath a piece of furniture. The support assembly in this embodiment includes a counter-balance member which is adjustable and can be positioned adjacent an underside surface of the piece of furniture. The piece of furniture interacts with the counter-balance member to prevent the assembly from tipping when the user rests part of their upper body, including their arms, on the armrests. In another embodiment, the assembly includes a support frame and an upper body support apparatus. The upper body support apparatus is movably engaged with the support frame to permit the apparatus to be moved underneath a piece of furniture when not in use.

26 Claims, 21 Drawing Sheets

UPPER TORSO SUPPORT FOR A WORKSTATION

RELATED APPLICATIONS

The present application is a continuation in part of U.S. patent application Ser. No. 08/309,119, filed Nov. 8, 1994, now U.S. Pat. No. 5,605,311, entitled "UPPER TORSO SUPPORT FOR A WORKSTATION".

FIELD OF THE INVENTION

The present invention relates to an upper body support apparatus for workstations and, more particularly, to an adjustable, sturdy upper body support and work platform incorporated into a standalone frame or into a desk workstation.

BACKGROUND OF THE INVENTION

Our modern technologically oriented society has what appears to be an insatiable demand for information. The preferred form for efficient storage and access of such information is in the memory of a computer or database. Consequently, there is an ever increasing need for word processors or data entry operators to input large volumes of information. These workers by definition must spend many hours doing repetitive tasks in a constant sitting position. In addition to the most demanding data entry positions of telephone operators, supermarket check-out clerks and such, a growing number of white collar workers up to and including executives of large corporations are relying more and more on computer use. Furthermore, other tedious and repetitive tasks such as machine shop and assembly line work require the worker to assume a stable body position with the arms and hands manipulating tools and work pieces within a confined area.

These tasks are often performed by workers who must maintain their body in a position where they engage in static exertions. Specifically, the workers have to continuously maintain a particular body position against the force of gravity which requires the user to exert a significant force even though they may not be moving their bodies a significant amount. For example, a data entry operator has to continuously maintain his or her arms in an outstretched manner while engaging in a continuously repetitive activity. The combination of this static exertion and the continuous repetitive activity is the cause of significant injury to workers.

Stationary, repetitive work may eventually lead to many different kinds of health problems, chiefly among those being any one of a number of maladies classed as "repetitive strain injures" (RSI). RSI is a cumulative condition that causes everything from persistent aches in arms and hands to crippling, career-ending pain. Every year, thousands of people must leave work because of RSI. The cost to companies in both lost productivity and worker's compensation claims is enormous. The most commonly reported RSI is a condition known as Carpal Tunnel Syndrome. This condition occurs when some or all of the nine wrist tendons swell to crowd the nearby median nerve which shares space with the tendons within the carpal tunnel. Carpal Tunnel Syndrome accounts for a large portion of the occupational injuries reported each year to the Bureau of Labor Statistics. Furthermore, surgery for Carpal Tunnel Syndrome is the second most common surgical procedure in the nation. In addition to the more widely known Carpal Tunnel Syndrome, there has been an increase in the number of reported cases of arm tendinitis and lumbar back pain, among other ailments, caused by less than optimum work station environments.

A worker who suffers a disabling injury from such chronic physical stress can cost a company a substantial amount of money in Workman's Compensation claims. Indeed, the average Workman's Compensation claim in cases such as these is currently approximately $70,000. Even more ominous for businesses is the increasing number of personal injury suits filed by employees who claim disabling on-the-job injuries from inadequate workstation environments. In addition to this large financial risk, various government agencies are implementing new laws intended to pressure employers to provide adequate working environments to minimize such injuries. The Occupational Safety and Health Administration (OSHA), for example, plans to force all types of businesses to cut the risk of RSI's.

In response to these health problems, there have been numerous attempts at supporting the forearms and wrists of typists to prevent such nerve aggravation. Many offices provide simple padded supports along the front of the keyboard upon which the operator may rest his or her wrists. Unfortunately, although this helps alleviate wrist and finger fatigue, the forearm and upper body is not supported and may experience discomfort. Other solutions have provided adjustable chair armrests for supporting the forearm during typing or other such repetitive work. Unfortunately, many office chairs do not include armrests.

There have been several specialized apparatuses adaptable to a desk or a chair for supporting the forearm. One example is shown in U.S. Pat. No. 5,215,282 to Bonutti. This patent discloses an assembly which includes a pair of padded armrests pivotably mounted on tubes attached to the underside of a desk or to a chair or chair arm. The structure supporting the armrests is relatively lightweight and the device is intended only for supporting a short portion of a person's forearm. Further, although some pivoting adjustment is possible, and lateral movement is briefly mentioned, the total range of movement, and particularly the range of movement in a vertical direction, of any armrest attached to a fixed height desk or chair is necessarily limited.

Another wrist and forearm support is shown in U.S. Pat. No. 5,072,905 to Hyatt. The device hangs on the front edge of a desk and has two extending support members pivotable about attachment bolts. Again, the range of motion, especially in the vertical direction, is limited and the device is not suited for supporting excessive loads. In particular, since the device hangs on the front edge of the desk and the support members extend outward from the desk in a cantilevered fashion, excessive loads on the support members could result in the device becoming detached from the front of the desk or could also result in overbalancing the desk. Such excessive loads could result from the word processor or typist resting their upper body weight on the support surfaces.

U.S. Pat. No. 5,135,190 to Wilson and U.S. Pat. No. 5,281,001 to Bergsten et al. show other desk- or chair-mounted forearm support systems. U.S. Pat. No. 5,158,256 to Gross and U.S. Pat. No. 5,161,760 to Terbarck show accessories for supporting the wrist and forearm in front of a keyboard. In short, there have been numerous devices designed for supporting the wrist and/or forearm, and specifically designed to prevent the type of chronic injuries common to word processors.

Unfortunately, as mentioned above, prior wrist and/or forearm supports suffer from being relatively lightweight in construction and thus unsuitable for supporting large loads. The result is that the operator cannot rest his or her entire upper body weight on the support for fear of the device or supporting desk or chair breaking. Whether consciously or not, the operator then maintains the arms in a slight state of tension with a portion of their weight supported by the shoulders and back. Many injuries occur from these repetitive tasks farther up on the arm and beyond to the neck, back muscles and tendons as a result of an operator supporting a portion of the weight of their arms with these muscles and tendons for extended periods of time.

Recently, with the passage of the Americans With Disabilities Act (ADA) of 1992, employers are required to make workstations accessible to all employees, including the disabled. Often, persons in wheelchairs are prone to leaning heavily to one side over long periods. Prior forearm and wrist support systems are unable to provide adequate support for such heavy loads. There is thus a regulatory incentive for businesses to accommodate persons with disabilities to make their workstations ergonomically comfortable.

For some years now, there has been a need for a more sturdy workstation support and preferably one which has wider ranges of movement and provides more alternatives for the types of equipment used with it than do prior designs.

SUMMARY OF THE INVENTION

The present invention provides a solution to problems with prior wrist and forearm supports by increasing the strength and range of motion of an upper body support apparatus, and providing configurations of that apparatus that allow for options in things such as use and positioning of a mouse contact surface. The support apparatus can be incorporated into a standalone system or can be attached to a workstation. The upper body support apparatus preferably provides support for the worker's upper body to prevent static exertion and to assist the worker in avoiding poor posture.

In one preferred embodiment, the upper body support apparatus comprises a pair of armrests pivotably attached about two axes and slidable with respect to a frame. A wrist support pad and a keyboard platform are also supported above the frame. The armrests are padded and, in use, are positioned on both front lateral corners of the frame to provide, along with the wrist support pad, a uniform height upper body support which is both soft and sturdy.

In a preferred embodiment, the upper body support apparatus includes a pair of armrests having sturdy support assemblies attached to a central primary frame, the wrist support pad and the keyboard platform. The armrest support apparatus preferably comprises a U-shaped frame on either side of the central frame and is adapted to slide transversely into tubular members of the frame. A linkage bar is pivotably attached about a first axis to a connecting portion of the U-shaped frames and extends forward to pivotably attach about a second axis to an armrest bracket rigidly mounted within the armrests. The U-shaped frame thus may be slid transversely relative to the fixed central frame, while the armrests can be pivoted about two axes relative to the U-shaped frame.

In accordance with another aspect of the present invention, the armrest support assembly and armrest are of an extremely sturdy construction while maintaining a very low profile underneath to provide more room for a user's legs. More specifically, the U-shaped frame is formed of square tubular steel while the linkage bar is preferably a solid steel member. The pivot attachments of the linkage bar to the U-shaped frame and also to the armrest connection bracket are made by relatively large pivot bolts. Further, the armrest connection bracket is integrally formed with an inner rib fixedly attached to a support plate, thus forming a skeleton within the armrest. The support plate is preferably fastened into a recess in a lower layer of medium density fiberboard of the armrest. The rib, support plate, and lower layer of medium density fiberboard comprise an extremely strong support platform on which an operator may place his or her entire weight without fear of the apparatus buckling. The armrests are further bolstered by the addition of an intermediate layer of plywood above the medium density fiberboard, and are softened by two upper layers of urethane foam enclosed by a vinyl cover. A catch member transversely slidable with respect to the U-shaped frame can be retracted outward to form a stop for maintaining the armrest in a horizontal position or, alternatively, can be slid into the U-shaped frame to allow the armrests to pivot downward out of the way.

In accordance with one aspect of the present invention, the upper body support apparatus can be incorporated into a standalone frame having height adjustable legs and a pair of forwardly diverging feet. The height adjustable legs can position the upper body support apparatus optimally with respect to a seated user or, alternatively, can be raised up to provide a support for a standing user. In another embodiment, the upper body support apparatus can be mounted to a frame having a height adjustable work platform adjacent the keyboard platform. The work platform may provide a support for a keyboard, monitor, or other device. In a still further embodiment, the upper body support apparatus can be slidably mounted to a rigid frame underneath a larger, height-adjustable desk work station. The desk work station may be formed in an L-shape with a central recess accommodating the upper body support apparatus. In this version, the armrests have the same range of motion as in the previous embodiments. Another work station may be formed as a corner piece and have a recess for accommodating the upper body support apparatus in the inner corner of the desk.

A still further feature of the upper body support apparatus is a height and tilt adjustable keyboard platform. The platform is disposed rearwardly of the elongated wrist support pad and can be raised or lowered from underneath with a plurality of adjustment screws. Further, the keyboard platform can be angled with the adjustment screws to suit the particular user. Additionally, the keyboard split platform is sized to accommodate both the keyboard and a separate mouse pad. The mouse pad can be placed on either the right or left side of the keyboard depending on the hand of the operator.

In accordance with another feature of the present invention, the support assembly can be configured to have a counter-balancing member configured to be positioned underneath an existing table or workbench that counterbalances the weight of the user's upper body resting on an upper body support apparatus. In one embodiment, the upper body support apparatus is mounted on a height adjustable stand wherein the height adjustable stand is configured to be positioned underneath a table or workbench. An adjustable counter-balancing member is attached to the height adjustable stand where it can be positioned adjacent the underside of the desk. The counter-balancing member is preferably positioned on the side of the upper body support apparatus opposite the user. It is understood that the weight of the user results in the support assembly having a tendency to tip towards the user. Since the counter-balancing member is positioned on the opposite side of the upper body support apparatus, and is also positioned so as to rest against the underside of a desk or counter, the tendency of the desk to tip towards the user as a result of the user resting his or her weight on the armrest assembly is reduced. In the preferred embodiment, the counter-balancing member includes two adjustable stop members that include rubber stops that can be adjusted to rest against the underside of the desk or counter.

In one preferred embodiment, the support assembly with the counter-balancing member is configured to include a platform for a keyboard. Alternatively, in another embodiment, the support assembly with the counter-balancing member does not have the platform for the keyboard. It can be appreciated that some existing counters, tables and desks have keyboards already mounted thereon. This embodiment of the present invention is thus configured to be used with existing counters, tables and desks of this type.

In yet another aspect of the present invention, the support assembly is configured to be used with an existing desk, table or counter and is configured to slide underneath the desk, table or counter when not in use. In one preferred embodiment, the support assembly includes a height adjustable stand that is movably engaged with a track so that the height adjustable stand and the upper body support apparatus can be rolled underneath the desk, table or counter. While one embodiment of the invention discloses the rolling engagement between the height adjustable stand and the track in conjunction with an apparatus that is equipped with a counter-balancing member, it will be appreciated that each of the embodiments of the assembly or system can be configured to be movable underneath a desk, etc., when not in use without departing from the scope of this aspect of the invention.

From the foregoing, it should be apparent that the previously described embodiments of the present invention provide an assembly or system that provides full upper body support for a worker who is engaged in some repetitive task such as typing, etc. Further, this apparatus can be configured to be used with existing furniture, e.g., desks, tables, counters, etc., and can also be configured so that it can be stored under the furniture when not in use.

These and other objects and features of the present invention will become more fully apparent from the following description and appended claims taken in conjunction with the accompanying drawings.

DESCRIPTION OF THE PREFERRED EMBODIMENTS

The following description refers to various illustrated embodiments of an upper body support system or assemblies incorporated into several rigid support assemblies comprising various workstations. Descriptions of each of the different versions will be separated by subheadings.

Standalone Support Assembly

Figure 1:
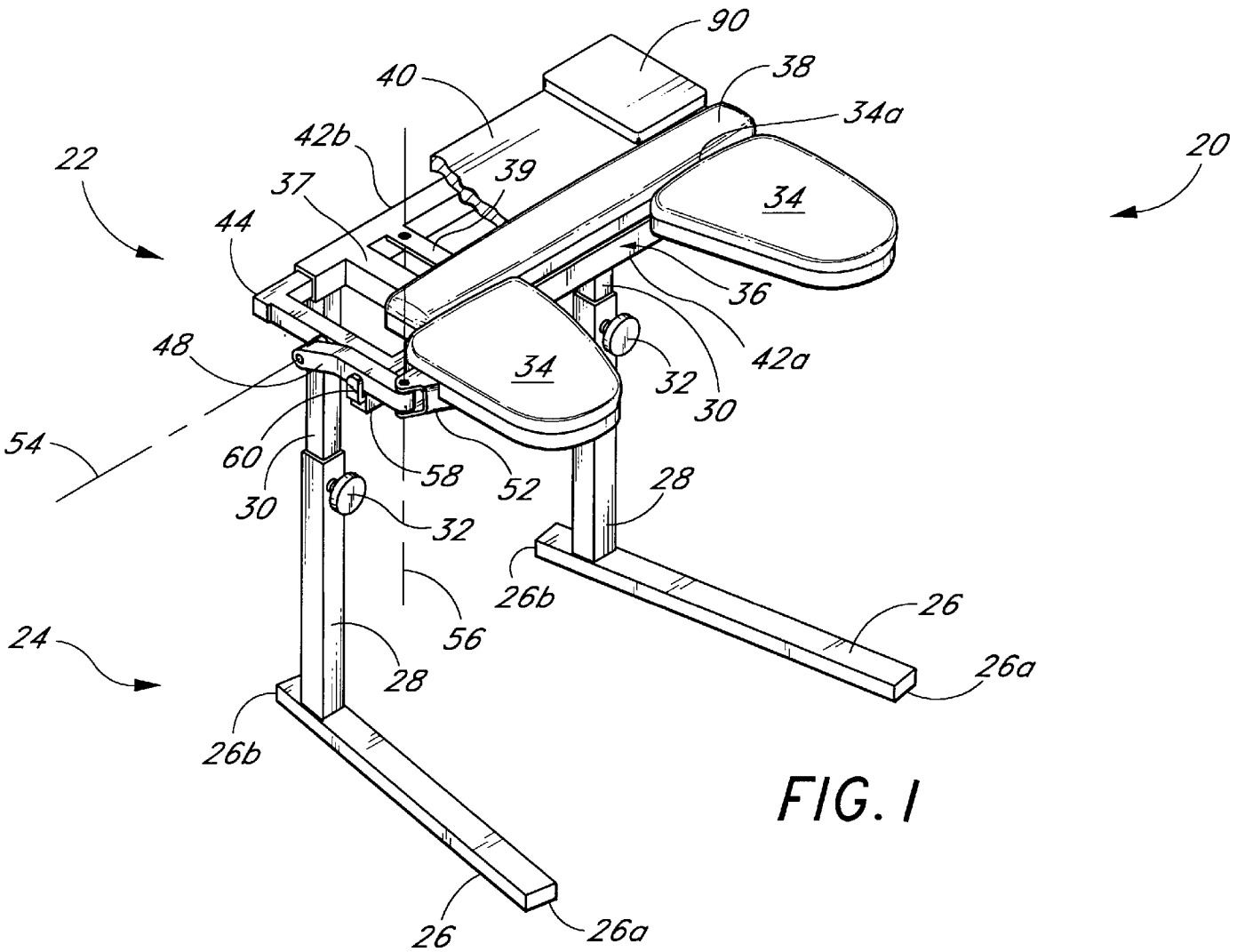
FIG. 1 is a perspective view of a standalone version of an upper body support system in accordance with the present invention.

A standalone version of an upper body support system of the present invention is designated as 20 in FIG. 1. The system 20 generally comprises an adjustable upper body support apparatus 22 mounted on a height adjustable stand 24, together defining a support frame. The stand 24 comprises a pair of outwardly diverging feet 26 welded to a pair of upstanding lower tubular stanchions 28 sized to slidably receive a pair of upper tubular stanchions 30. The adjustable upper body support 22 is rigidly attached, such as by welding, to the upper ends of the tubular stanchions 30. The upper body support 22 extends generally horizontally forward from the upper tubular stanchion 30, and parallel to the lower feet 26. A pair of height adjusting knobs 32 allow tightening of a threaded rod (not numbered) passing through threaded apertures in the lower tubular stanchions 28 against the upper tubular stanchions 30. Thus, the height of the upper body support 22 can be adjusted above a base surface on which the feet 26 rest, as seen by double-headed arrow 33 of FIG. 3. In one preferred embodiment, the height of the standalone system 20 can be adjusted between 24 inches and 39 inches and it has a width of approximately 26 inches.

Height adjustment of the upper body support 22 is in itself a vast improvement over prior wrist and forearm supports attached to fixed height desks or to chair arms. The ability to adjust the height of the arm support is perhaps the single most important feature to avoid bad posture and attendant back and neck problems. Furthermore, the wide range of adjustment of the height allows a user to either sit or stand and utilize the upper body support 22.

The standalone upper body support system 20 shown in FIG. 1 is designed to be placed between a worker, such as a keyboard operator (not shown), and a desk or other work platform. In the most common usage of the system 20, a keyboard operator sits in an armless chair in front of the system and between the lower support feet 26. In a highly desirable method of customizing a workstation, the user first adjusts his or her seat to the most comfortable height. Then, the support system 20 is adjusted to an ergonomically optimum height with respect to the individual sitting at the preferred seat height. The optimum position has the user sitting upright with their arms resting naturally on the upper body support apparatus 22. The encompassing and sturdy nature of the present invention encourages the user to accommodate to the correct position to minimize chronic injuries from poor posture.

At the lower portion of the stanchions 28, the support feet 26 diverge slightly outward from a centerline of the system by approximately 15°. Thus, the forward ends 26*a* of the feet are spaced farther apart than the rear ends 26*b*. This divergence increases the area between the forward ends 26*a* of the feet and provides more maneuvering room for the user's chair, which is typically on rollers. Furthermore, the skewed angle at which the feet 26 meet the lower stanchions 28 increases the strength in bending of the welded joint between the feet 26 and the lower stanchions 28. The bending moment applied at the joint by someone leaning on the upper body support apparatus 22 results in a lower stress due to the higher area moment of inertia of the joint, having a skewed angle, than for a joint where the feet point straight forward. This is perhaps best envisioned by the fact that it is more difficult to bend a square tubular member about an axis which is not parallel to one of its sides. In other words, the area moment of inertia is greater for these nonorthogonal bending axes. Finally, the feet 26 extend far enough forward to provide adequate support for the upper body support apparatus 22 to prevent the entire system 20 from tipping when weight is applied.

Figure 2:
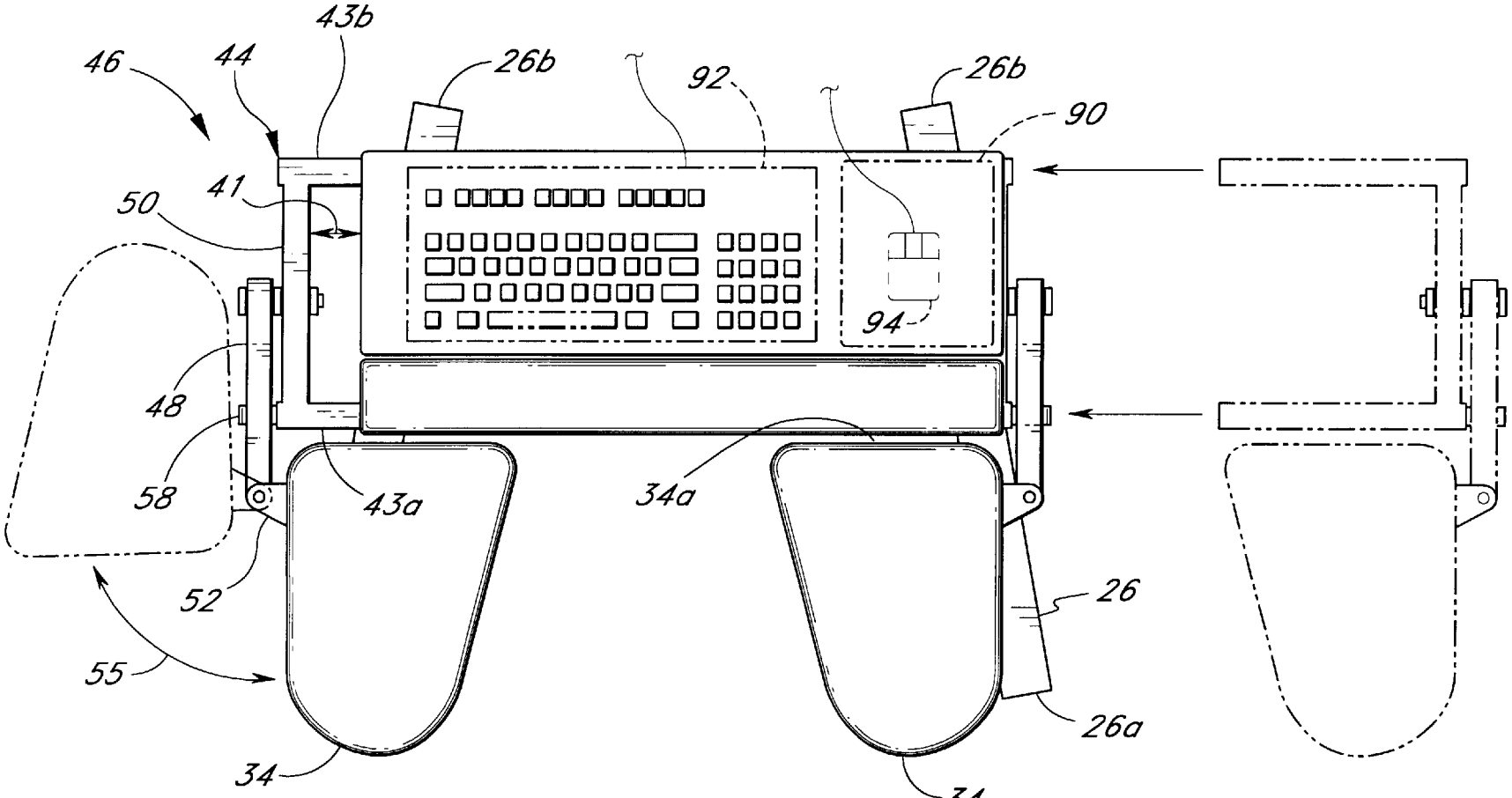
FIG. 2 is a top plan view of the system of FIG. 1.
Figure 3:
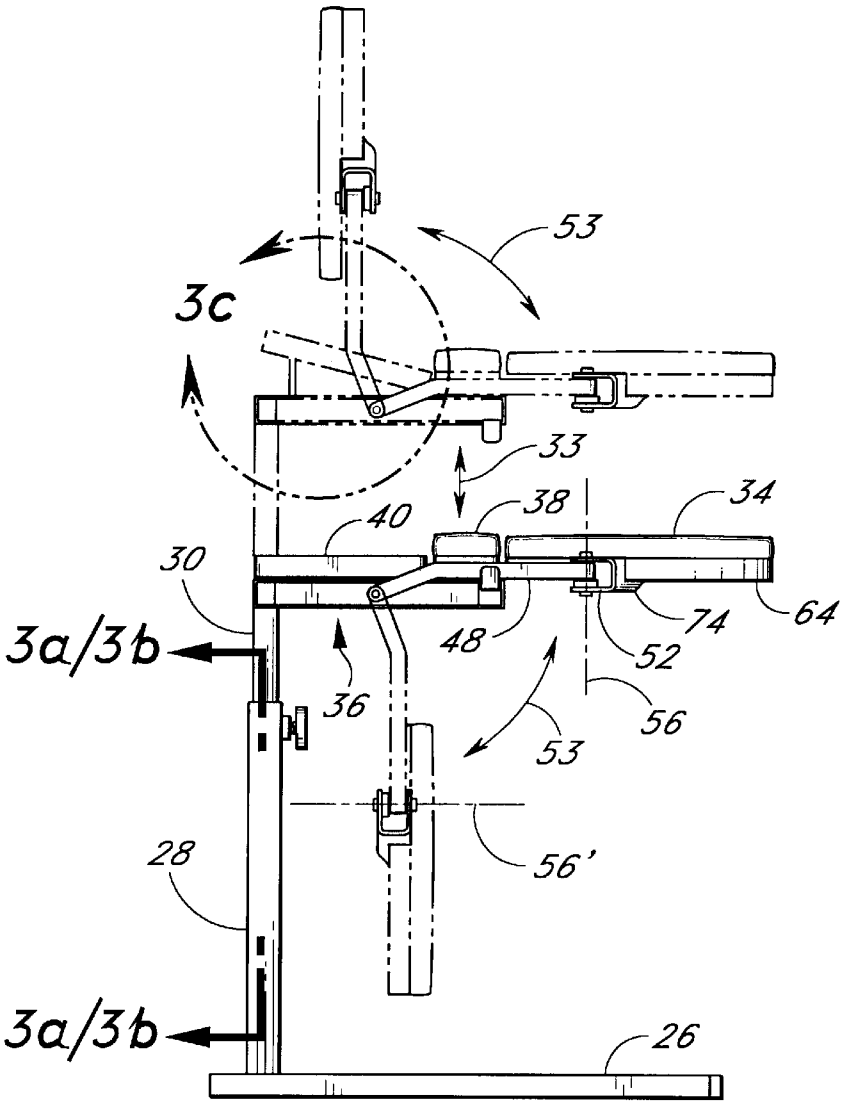
FIG. 3 is a side elevational view of the support system of FIG. 1 showing various ranges of movement.

Now with reference to FIGS. 1–3, the upper body support 22 generally comprises a pair of armrests 34 pivotable and slidable with respect to a horizontal subframe 36, and a padded wrist support 38 and keyboard platform 40 both mounted on top of the frame and together providing a work surface. Although not entirely shown in FIG. 1, the subframe 36 is disposed generally horizontally underneath the upper body support apparatus 22 and is mounted rigidly to the upper tubular stanchions 30. More particularly, the horizontal subframe 36 includes a pair of transverse tubular members 42*a,* 42*b* connected longitudinally by at least two tubular cross-members 37 and flat struts 39 (FIG. 3*b*). The rear tubular member 42*b* is rigidly attached to the top end of the upper stanchions 30, while the cross-members 37 connect the rear tubular member 42*b* to the front tubular member 42*a,* the connections preferably being welded.

In normal use, the armrests 34 are mounted with respect to the horizontal subframe 36 to extend forwardly therefrom. More particularly, a rear edge 34*a* of each of the armrests 34 lies coincident with a forward edge of the subframe 36, or adjacent the front tubular member 42*a*. The system 20 is designed so that a user may place a substantial weight on the armrest 34 without the device tipping forward. To accomplish this, the feet 26 extend forward from the front tubular member 42*a* of the horizontal subframe 36. In a preferred embodiment, the feet 26 extend forward approximately the distance of the forwardly extending armrests 34. As seen in FIG. 2, the front ends 26*a* of the feet are approximately directly underneath the front edges of the armrests 34. This arrangement, along with the extremely sturdy construction of the system 20, ensures that the system will not tip or buckle when a user places his or her entire weight on the armrests 34.

Advantageously, the position of the armrests 34 can be optimally adjusted transversely to provide support for the arms from the elbow to the wrist close to the trunk of various individuals, whose sizes may differ greatly. Biomechanical analyses have determined that the line along the humerus, or upper arm bone, should be approximately vertical to result in the least amount of static musculoskeletal stress. The head of the humerus rotates within the glenoid cavity of the scapula, or shoulder blade, to define the shoulder joint. Primary movement of the humerus is about three orthogonal axes oriented relative to the plane of the scapula. Angulation of the humerus in the plane of the scapula about a generally transverse horizontal axis is termed abduction and adduction. Abduction is angulation of the upper arm away from the side of the body and adduction is toward the body. In general, when sitting for long periods typing, one should minimize abduction and maintain the upper arm in close elbow-to-body contact. Shoulder abduction associated with widely spaced arm supports may require excessive ulnar deviation of the hands for proper alignment of the fingers at the keyboard. Of course, with varying anatomies, the optimum position may vary somewhat, and to reduce the chance of suffering a chronic stress injury, the optimum position is that which places the muscles and tendons in the most relaxed position. More specifically, the average person can minimize chronic stress by maintaining the upper arm at an angle of between 0°–20°, and more preferably between 5°–15°, with the vertical.

The ability to transversely adjust the position of the armrests 34 thus provides the capability to minimize chronic stress of the upper body muscles and tendons associated with excessive abduction of the upper arm. On each transverse end of the upper body support 22, the transverse frame members 42*a,b* are open to receive legs 43*a,* 43*b* of U-shaped frames 44 forming part of an armrest support assembly 46. The U-shaped frame 44 can slide transversely with respect to the horizontal subframe 36 as shown by double arrow 41 of FIG. 2.

In addition to the U-shaped frames 44, the armrest support assembly 46 includes a rigid linkage bar 48 pivotably mounted at a first end to a connecting section 50 (FIG. 2) of the U-shaped frame, and an armrest bracket 52 adapted to pivot about a second end of the linkage bar in a pin and clevis arrangement. The entire armrest assembly 46 can thus be slid transversely relative to the subframe 36 via the telescoping fit of the U-shaped frame legs 43 in the transverse tubular members 42. Additionally, the linkage bar 48 and attached armrest 34 can pivot about a transverse axis 54 (FIG. 1) through the first end of the linkage bar 48, as seen by arrows 53 in FIG. 3. Finally, the armrest 34 can pivot about an axis 56 (FIG. 1) passing through the connection point with the second end of the linkage bar 48, as seen by the arrow 55 of FIG. 2. In the illustration of FIGS. 1 and 2, the axis 56 is substantially vertical, but with pivoting of the linkage bar 48 about the transverse axis 54, the orientation of the axis 56 will change. For example, the linkage bar 48 is shown rotated downward in phantom in FIG. 3 so that the reoriented axis 56' is substantially horizontal.

The armrest support assembly 46 includes a variety of ranges of motion for positioning the armrests 34 relative to an operator, or for pivoting the armrests out of the way for storage or transport. In use, however, the armrests 34 are preferably positioned as shown in FIG. 1 with the linkage bar 48 resting horizontally on a rigid pin or catch member 58. As mentioned above, a rear edge 34*a* of the armrests is coincident with a first edge of the horizontal subframe 36, or adjacent the front tubular member 42*a*. This optimum positioning provides a planar support surface for a user's wrist and forearm on the wrist pad 38 and armrest 34. More particularly, the wrist pad 38 includes a rigid base fixedly attached to the horizontal subframe 36 and an upper cushion comprising a foam filled vinyl pad. The wrist pad 38 extends the entire transverse width of the keyboard platform 40 which, along with the transversely adjustable armrest 34, provides the planar wrist and forearm support for users having varying girths. In order to hold the armrests 34 in a desired position adjacent the front tubular member 42*a,* a pair of mating hook and loop fastening strips (not shown) may be provided on the tubular member and on the rear edge 34*a* of the armrest.

The catch member 58 preferably comprises an element sized to fit within a front tubular leg 43*a* (FIG. 2) of each of the U-shaped frames 44. In the standard position shown, the catch member 58 extends outward from the U-shaped frame leg 43*a* so as to provide a support base for the linkage bar 48. The catch member 58 is sturdily constructed to support the weight of an operator's arm and upper body as applied onto the armrest 34. In order for the linkage bar 48 and armrest 34 to pivot downward, the catch member 58 is simply slid inward into the tubular leg 43*a* of the U-shaped frame 44. A bent tab 60 (FIG. 1) or other such structure is provided to prevent the catch member 58 from sliding completely within the U-shaped frame 44. Other retractable catch members suitably rigid for supporting the weight of a user's upper body are possible, and the presently illustrated catch member 58 is shown as an example only.

An important feature of the upper body support apparatus 22 of the present invention is its sturdy construction. In particular, the armrest support assembly 46 is preferably constructed of rugged steel components in contrast to prior designs. The intent is to provide support for the entire arms and upper body of a user rather than simply the wrist and forearm. To this end, the linkage bar 48 is preferably a solid, square cross-sectional bar pivotably attached at both ends with fairly large attachment bolts. Additionally, the armrest bracket 52 and armrest 34 itself are both very sturdily constructed, as detailed below.

Indeed, in one preferred embodiment, the entire standalone support body support system 20 includes a frame made of steel elements of 1.25 inch wide, 0.095 inch thick square tubing. As seen in FIG. 3*a,* the lower tubular stanchions 28 are slightly larger and thinner, preferably 0.065 inches in thickness, but possess sufficient structural strength to withstand most users applying their entire weight onto the armrests 34. Similarly, the armrest support assembly 46 is sturdily built of steel members. The particular steel used is somewhat malleable, however, to provide the advantageous dual qualities of strength and flexibility. This flexibility adds a further measure of comfort to a user leaning on the armrests as the apparatus "gives" slightly. The feet 26 are desirably constructed of more sturdy rectangular channel members having a width greater than the height. In one embodiment, the feet 26 are constructed of 0.120 inch thick rectangular tubing having a width of 2 inches and a height of 1 inch. The preferred steel used for the structural members of the system 20 is a mild grade B steel having tensile strength of at least 60 kpsi, a yield strength of at least 50 kpsi, and having the capability of elongating at least 20% before rupture. One example of such mild steel is ASTM A500 having a tensile strength of 58 kpsi and a yield strength of 46 kpsi. The preferred steel may be replaced by other materials having suitable properties to ensure that excess loading of the system 20 will bend the structural members rather than break them.

Figure 4:
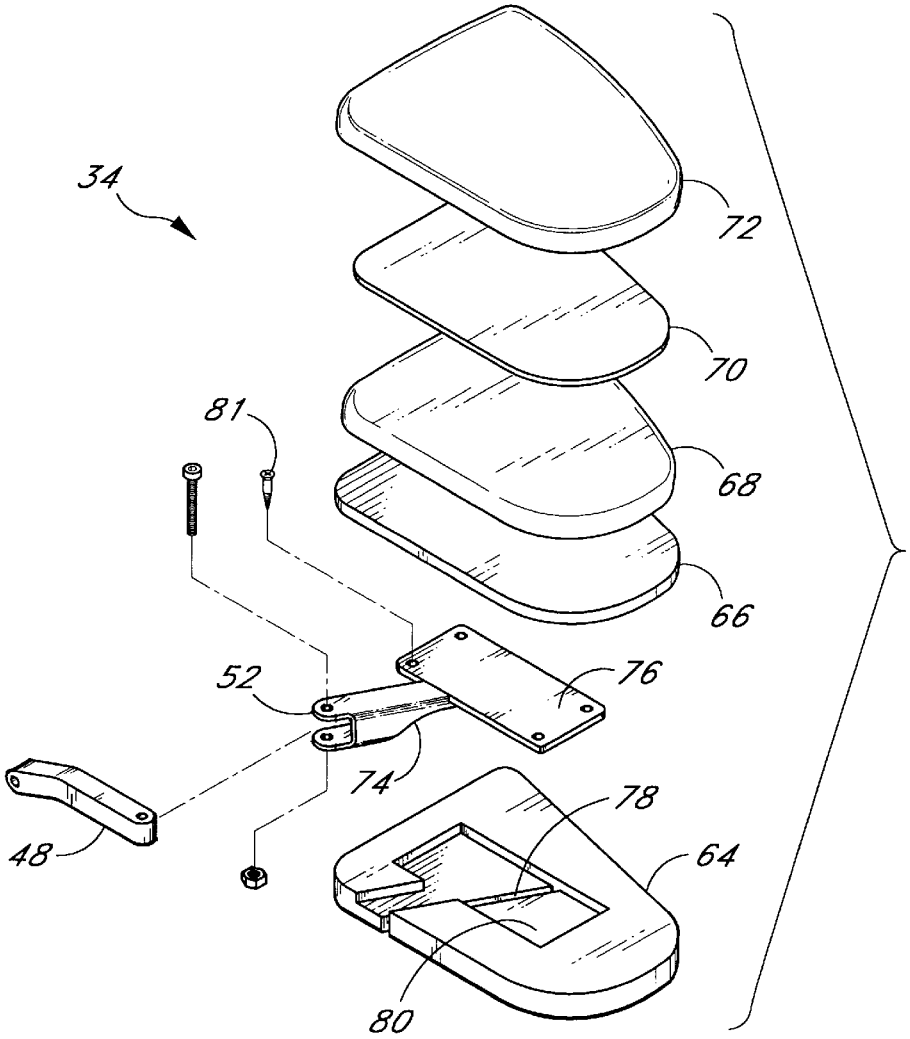
FIG. 4 is an exploded view of an armrest and support assembly of the present invention.

With reference now to the exploded view of FIG. 4, the armrest 34 comprises a composite assembly having a fairly rigid skeleton and several layers of padding on the top. More specifically, the armrest 34 comprises a lower panel of medium density fiberboard 64, an intermediate layer of plywood 66, a first layer of closed cell foam rubber 68, an upper layer of foam rubber 70, and an outer flexible covering 72 of vinyl or other similar covering. The layers are stacked together with the medium density fiberboard 64 and plywood layers 66 being held together with wood screws or other such fasteners (not shown) and the foam rubber layers 68, 70 being adhered to the plywood and to each other. The vinyl covering 72 is preferably stretched over the armrest 34 and held between the medium density fiberboard 64 and plywood layers 66. For increased strength, the armrest bracket 52 is integrally formed with a generally vertical rib 74 and a connector plate 76. The rib 74 fits within a diagonal slot 78 cut into the medium density fiberboard 64 while the connector plate 76 is recessed in the top of the fiberboard in a cavity 80. The connector plate 76 is held rigidly to the fiberboard 64 by a plurality of fasteners, one of which is shown at 81. Advantageously, this construction is sturdy and avoids any downwardly depending support structure below the fiberboard layer 64. Thus, not only can a user support his or her entire weight on the armrest 34, but the thin, layered construction provides a maximum amount of room underneath the armrest 34, as best seen in FIG. 5*a*. Preferably, the armrests are designed to support at least 200 lbs. without bending.

The armrests 34 are made to conform with existing fire safety regulations. More particularly, the present armrests 34, being foam filled products which support a user's limb, are classified by governmental regulatory agencies as furniture, and thus are fire tested to conform with fire safety standards applicable to furniture. Presently, the armrests 34 are rated by the California Department of Consumer Affairs, Home Furnishings Division, under Bulletins 116 and 117. Many smaller wrist pad supports for keyboard operators currently on the market are not classified as furniture as they do not "support" a limb or other body part and thus are not required to conform with these fire safety regulations.

Now with reference to FIGS. 3*a* and 3*b,* the sliding interaction between the upper tubular stanchions 30 and lower tubular stanchions 28 is seen. A nonscratching polymer sleeve 82 is placed between the upper and lower stanchions to prevent scratching of the outer surface of the upper stanchion 30. The sleeve 82 is preferably an extrusion of ABS plastic. If the sleeve 82 were not provided, the upper stanchions 30 might become scratched and unsightly from repeated insertion and removal from the lower stanchions 28. In another advantageous feature, a relatively large helical spring 84 is placed within each of the lower tubular stanchions 28. The spring 84 has a diameter sized to fit within the inner channel of the upper tubular stanchions such that the upper stanchion 30 compresses the spring within the lower stanchion 28. The springs 84 have a length and spring stiffness such that the adjustable upper body support apparatus 22 is held at a height above a base which positions the upper body support apparatus 22 at a height convenient for the average sized user of the system 20. Thus, if the adjustable upper body support apparatus 22 needs to be raised up from this average height, it is less work for the user due to the springs 84. If the support apparatus 22 needs to be lowered, the user simply presses the apparatus down against the force of the springs 84 to the desired height and tightens the knobs 32 to retain the support apparatus 22 at this height.

FIG. 3*b* illustrates another embodiment of an apparatus which maintains the upper stanchions 30 at a desired height. In the embodiment shown in FIG. 3*b,* the spring 84 of FIG. 3*a* is replaced by a piston 83. The piston 83 exerts an upward force against a stop 85 that is fixedly mounted to the end of the upper stanchion 30. Preferably, the piston 83 exerts a force which is just sufficient to overcome the weight of the apparatus 22 and the stanchions 30, while allowing a user to move the apparatus 22 downward, against the force of the piston 83, by simply pushing the apparatus 22 downward. Once the apparatus 22 is at its desired height, the user can then secure the apparatus 22 at the desired height by tightening the height adjusting knobs 32 through the lower stanchions 28 against the upper stanchions 30 in the manner shown in FIG. 3*b*.

Figure 3C:
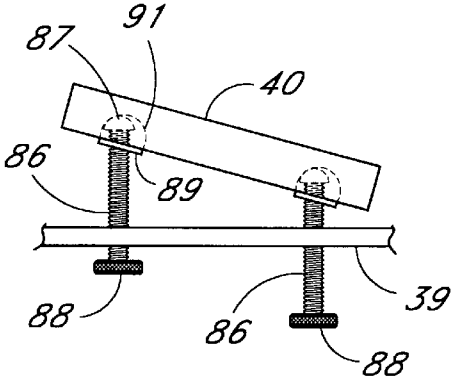
FIG. 3*c* is a detailed elevational view of a keyboard platform height/tilt adjustment mechanism in accordance with the present invention.
Figure 3B:
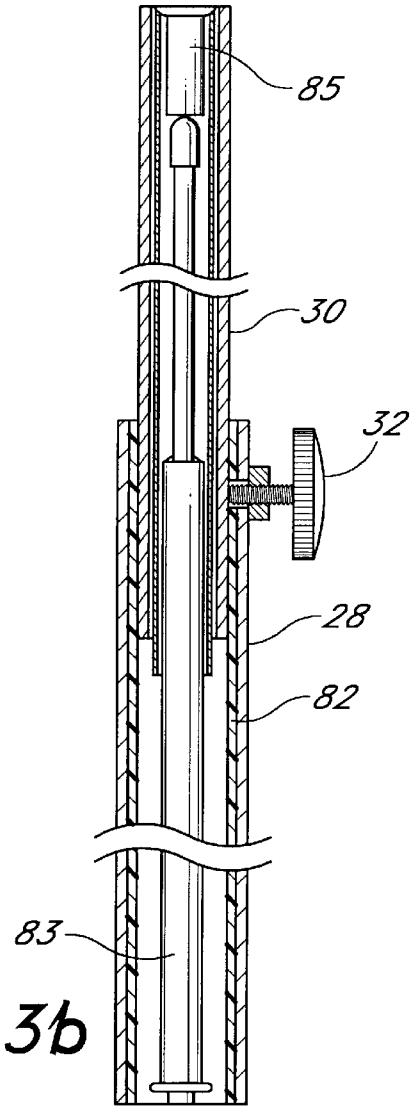
FIG. 3*b* is a cross-sectional view of an alternate embodiment of a support tube which can be used to provide support for the system.
Figure 3A:
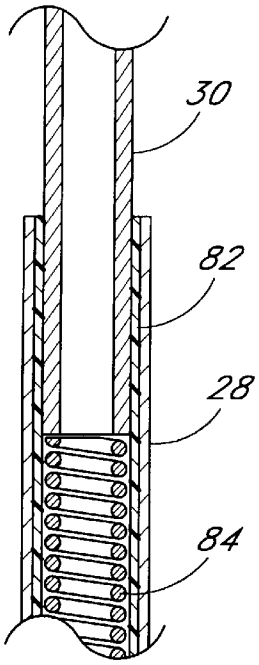
FIG. 3*a* is a cross-sectional view along a vertical support tube of the support system taken along line 3*a*—3*a* of FIG. 3.

Now, with reference to FIG. 3*c,* it can be seen that the height and angle of inclination of the keyboard platform 40 can be adjusted. More specifically, the horizontal subframe 36 includes a pair of generally flat struts 39 having threaded holes through which adjustment bolts 86 extend. There are four adjustment bolts 86—two on either lateral side of the subframe 36. Each pair of bolts 86 on each lateral side are preferably spaced from the front and back end of the keyboard platform 40, and thus are normally hidden. The bolts include adjustment knobs 88 which can be manipulated to change the height or the angle at which the keyboard platform is positioned with respect to the horizontal subframe 36. The upper end of each bolt 86 has a cap nut 87 captured by an apertured plate 89 within a recess 91 in the underside of the keyboard platform 40 to allow relative angular motion therebetween. The adjustment of the keyboard platform 40 allows the user to customize the keyboard angle and height for the various styles and sizes of keyboards on the market.

With reference to FIGS. 1 and 2 again, a mouse pad 90 is provided to fit on the keyboard platform 40 next to a keyboard 92. The mouse pad 90 includes a frictional upper surface on which a mouse 94 (FIG. 2) can be dragged to change the position of an arrow or cursor on the monitor of a computer. Advantageously, the keyboard platform 40 has a lateral width such that both the mouse pad 90 and keyboard 92 fit comfortably thereon. The location of the mouse pad 90 and keyboard 92 can be reversed to provide for left or right handed operation of the mouse 94. The mouse pad 90 is constructed of several laminated layers, and is preferably comprised of a lower layer of medium density fiberboard, an intermediate layer of plywood and an upper layer of closed cell foam rubber, covered by a flexible vinyl cover. The vinyl cover is preferably rougher than the cover provided on the armrests 34 to allow for greater friction with the mouse 94. As previously mentioned, a planar support surface is provided along the armrest 34 and wrist pad 38. With the provision of the mouse pad 90, a user can support his or her entire arm from the elbow all the way to the fingers along the three elements of the armrest 34, wrist pad 38 and mouse pad 90. Such desirable and adjustable comprehensive arm and wrist support has previously been unavailable.

Figure 5B:
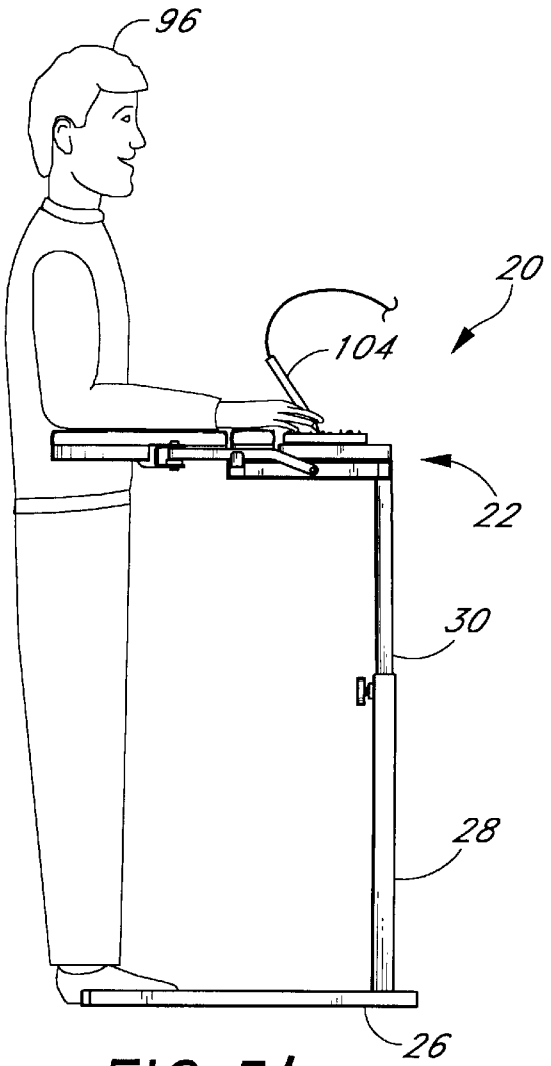
FIG. 5*b* is a side elevational view of the support assembly of FIG. 1 adapted for use by an assembly operator.
Figure 5A:
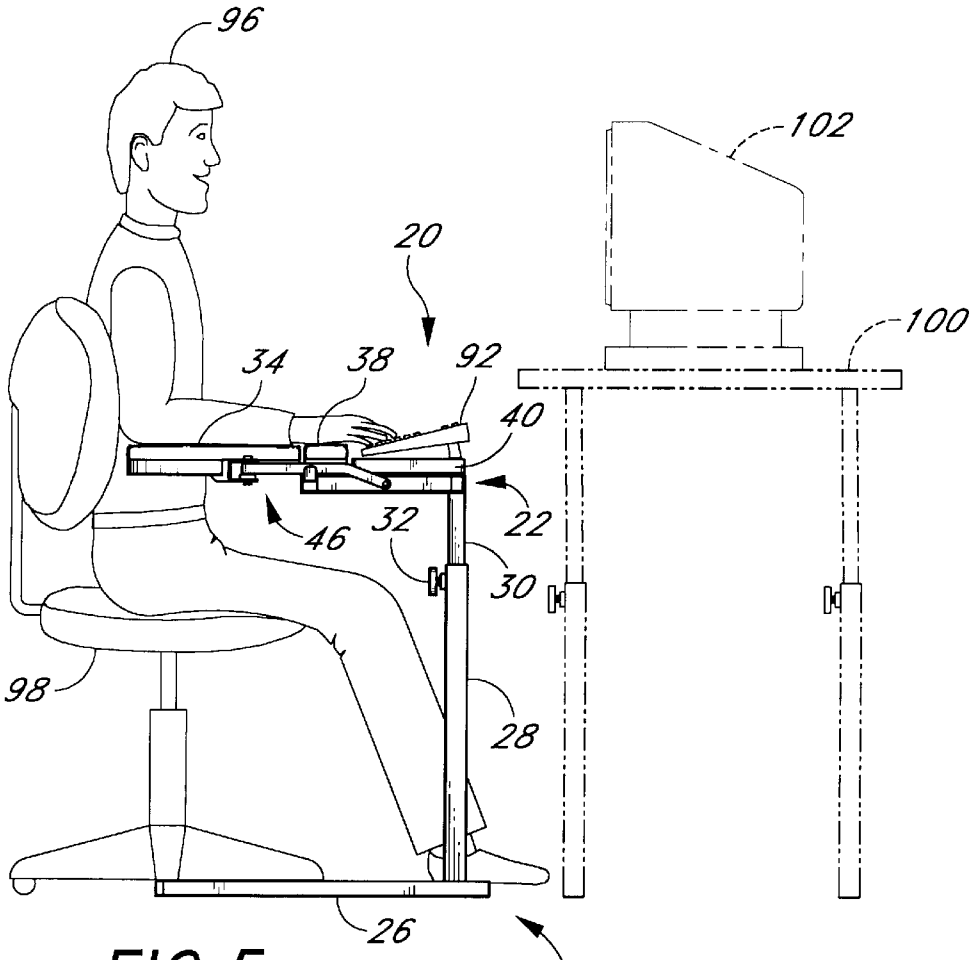
FIG. 5*a* is a side elevational view of the support assembly of FIG. 1 adapted for use by a keyboard operator.

Now with reference to FIGS. 5*a* and 5*b,* it can be seen that the standalone system 20 is extremely versatile in use. In FIG. 5*a,* a keyboard operator 96 sits at a chair 98 and rests his or her arms on the armrests 34 with the wrists placed on the padded wrist supports 38. The keyboard 92 is preferably angled with respect to the horizontal subframe 36 to be optimally positioned with respect to the operator 96, via the tiltable platform 40 or by independent legs on the keyboard 92. The height of the upper body support assembly 22 has been adjusted via the knobs 32 of the stand 24 to an optimum position customized to the operator 96. A height-adjustable table 100 may be provided to work in conjunction with the standalone system 20 for supporting a monitor 102. Although it is preferred to have a separate height adjustable table 100 as shown, the standalone system 20 is constructed so that it can be collapsed downward to fit under most conventional desks for storage when not in use.

In FIG. 5*b,* the standalone system 20 has been raised up to provide a work platform for an operator 96 in a standing position. The system 20 may be used in this configuration for activities such as assembly of circuit boards utilizing a soldering gun 104, and the like. FIG. 5*b* best illustrates the sturdy geometry of the standalone system 20, wherein the line of force of the operator's arms is directly downward over the forwardly extended feet 26. Because the system 20 is constructed ruggedly, the operator 96 can apply a substantial weight to the upper body support 22 without the system buckling. Hence, the support assembly 22 is constructed and configured to allow the operator to adjust the system to a desired height whereby the wrists, arms and upper body are supported by the support assembly 22.

Combination Upper Body Support and Height Adjustable Desk

Figure 6:
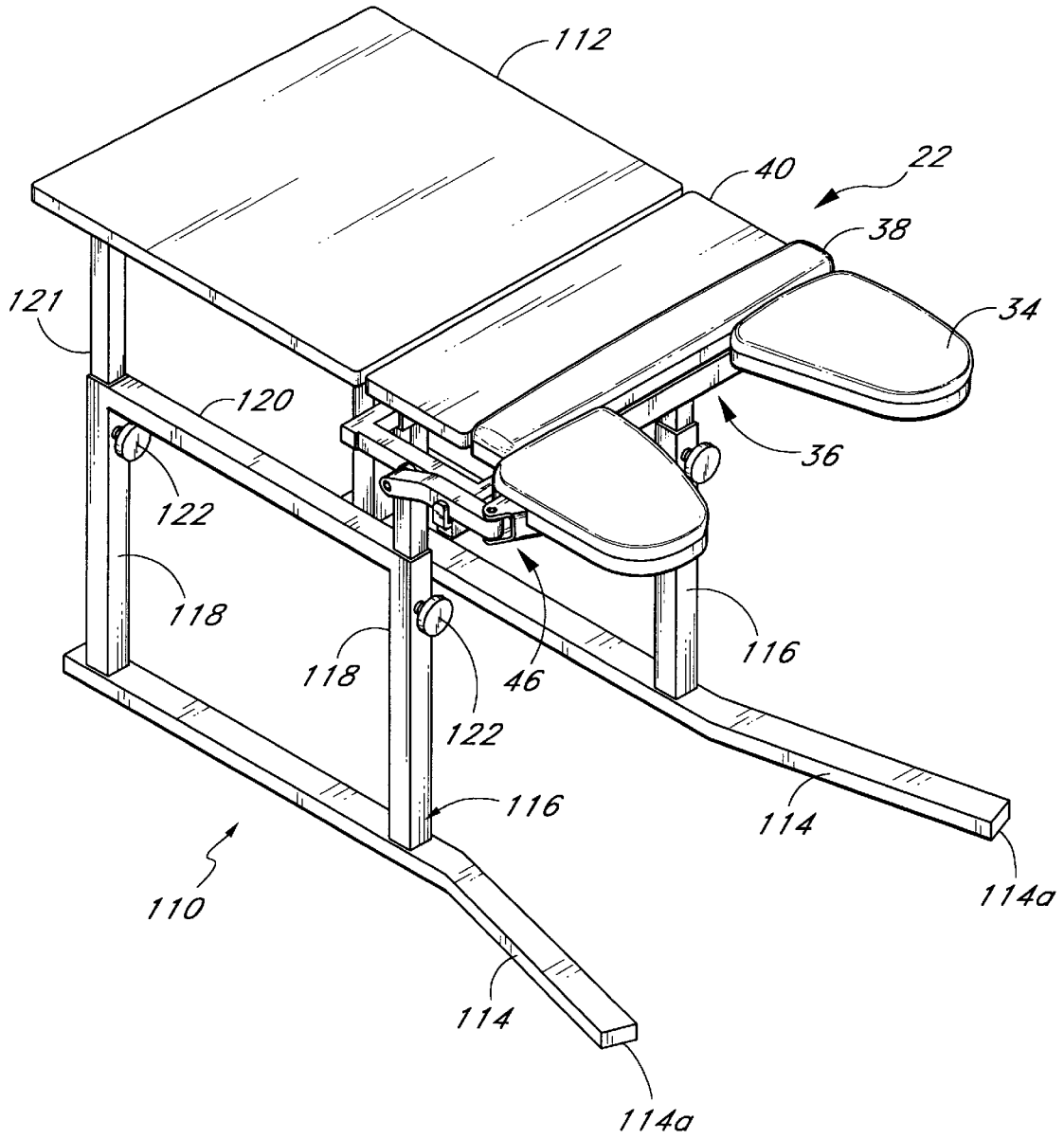
FIG. 6 is a perspective view of a second embodiment of an upper body support assembly incorporating a height adjustable work platform.

Now with reference to FIG. 6, the upper body support assembly 22 can be incorporated into a frame 110 which supports a height adjustable work platform 112. In this version, the frame 110 comprises a pair of elongated divergent feet 114 from which two inverted U-shaped frame members 116 are attached. The frame members 116 include upwardly extending tubular legs 118 and a horizontal crosspiece 120. The elongated feet 114 extend generally parallel between each pair of legs 118 and then diverge in a forward direction. Preferably, the feet 114 are bent at an approximately 15° angle forward of the front vertical legs 118. Such a divergence provides increased maneuver room between the front ends 114*a* for wheelchair-bound users, for instance. At the upper end of the legs 118, apertures are formed for receiving vertical stanchions 121 attached to the upper body support assembly 22 and to the work platform 112. A pair of adjusting knobs 122 for both the upper body support stanchions and the height adjustable work platform stanchions are provided. The upper body support assembly 22 is substantially as described with reference to FIGS. 1–5 and will not be described further, except to say that it comprises the armrests 34, the horizontal subframe 36, the padded wrist support 38, the keyboard platform 40 and the armrest support assembly 46.

Figure 7:
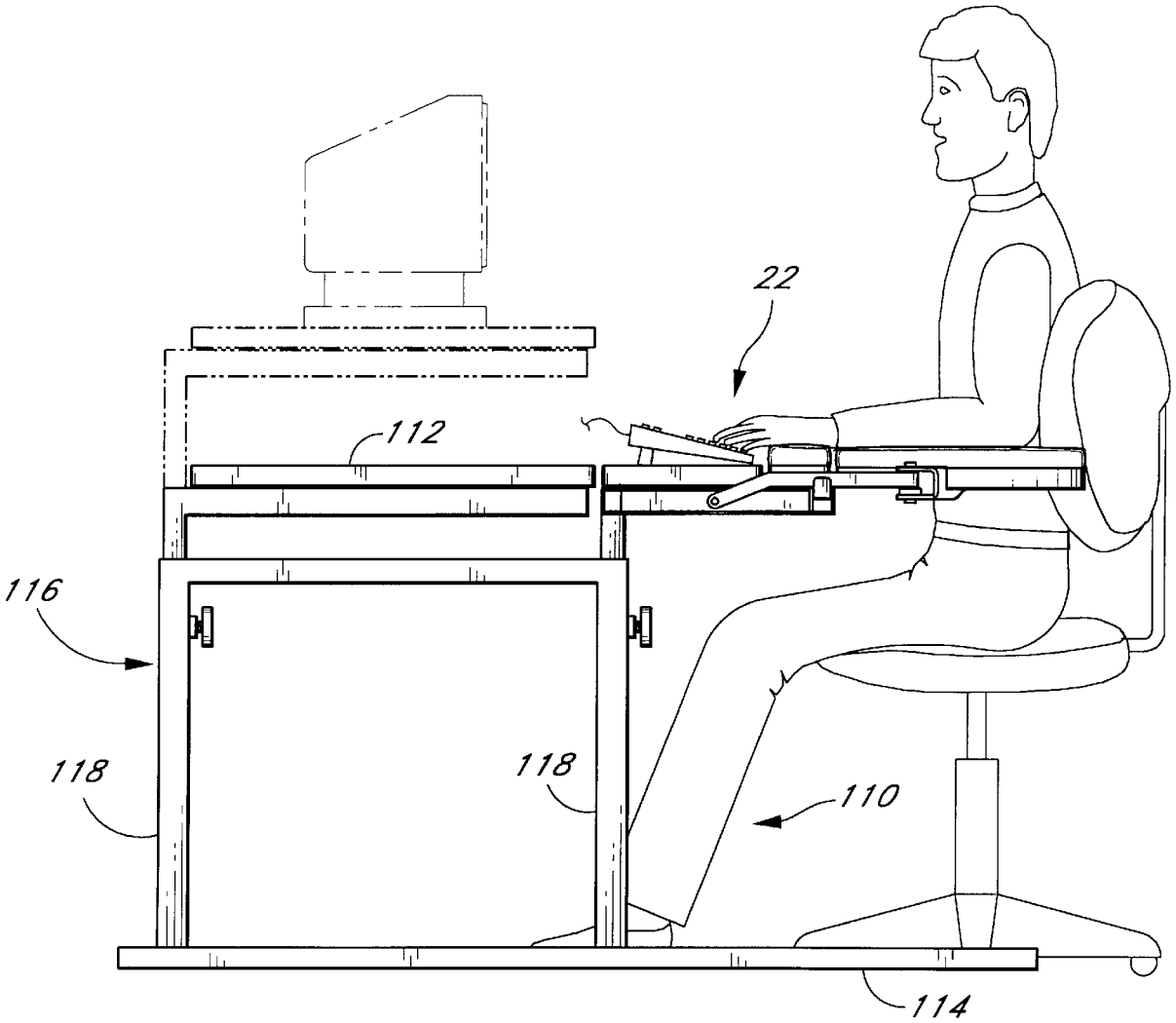
FIG. 7 is a side elevational view of the second support assembly embodiment of FIG. 6.

FIG. 7 shows the various ranges of motion of the height adjustable work platform 112. In this version, the work platform 112 and the upper body support assembly 22 are independently height adjustable to customize their positions for each user. Again, springs (not shown) are placed within the vertical legs 118 of the U-shaped member 116 to maintain a neutral height at a position optimized for the average person. In one preferred embodiment, both the upper body support assembly 22 and work platform 112 are adjustable between 24 inches and 29 inches off the ground.

Combination Upper Body Support and Surrounding Workstation

Figure 8:
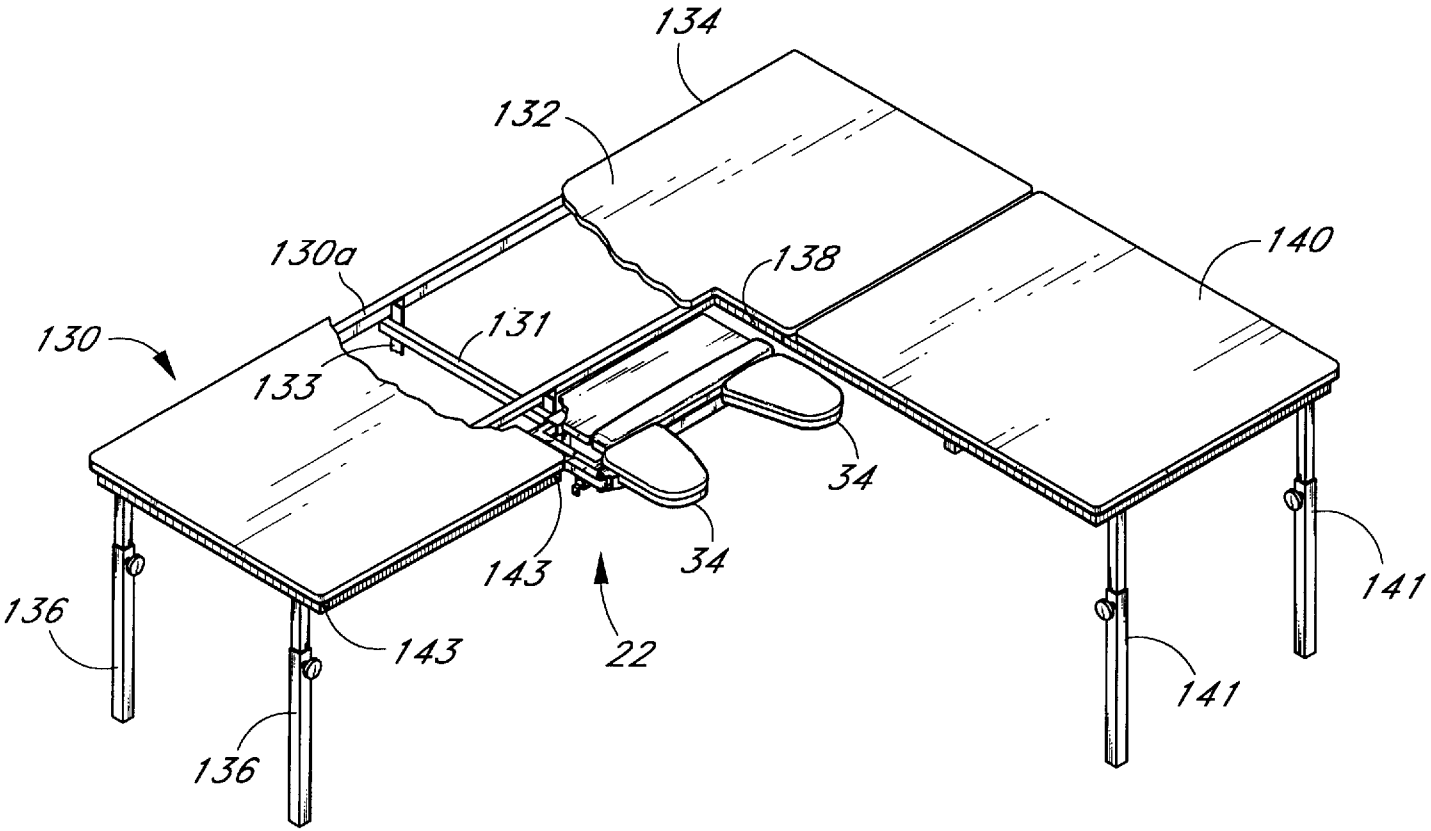
FIG. 8 is a perspective view of a third embodiment of the upper body support apparatus incorporated into a larger desk workstation.

In FIG. 8, an alternative workstation surrounding the upper body support assembly 22 is shown. In this embodiment, the workstation comprises a relatively large L-shaped desk 130 surrounding the upper body support assembly 22. The upper body support assembly 22 is preferably fixedly mounted at the same height as the desk 130 by structural members underneath the desk. The upper body support assembly 22 is mounted so that the armrests 34 can pivot, in the same manner as previously described in reference to FIG. 3, underneath the desktop 132. In a preferred embodiment, the upper body support assembly 22 includes a pair of rearwardly extending members 131 attached rigidly to downwardly depending brackets 133 from the frame 130*a* of the desk. This arrangement is schematically shown in FIG. 8, although other arrangements for affixing the frame of the upper body support assembly 22 to the desk frame may be utilized.

In the preferred embodiment, the desk 130 is formed in two pieces with a main body portion 134 having four height adjustable legs 136 on each corner and a central cut-out portion 138 on one side for the upper body support assembly 22. A side extension 140 having two height-adjustable legs 141 attaches to one of two positions relative to the main body 134. More particularly, the side extension 140 may be coupled to either the left or right side of the upper body support assembly to vary the desk 130 layout. The side extension 140 includes a pair of rod-like extensions which fit within apertures in the main body 134. In FIG. 8, the apertures 143 on the left side of the main body 134 are exposed. There may be structures underneath the desk sections 134, 140 to couple these sections temporarily together, as is well known by those of skill in the art. In the illustration of FIG. 8, the side extension 140 is attached to the right side of the upper body support assembly 22. The legs 141 of the side extension 140 provide the necessary structural support for a user placing his or her whole body weight on the armrests 34. In other words, the side extension 140 takes the place of the elongated feet 26 and 114 of the first two embodiments.

Combined Upper Body Support and Corner Workstation

Figure 9:
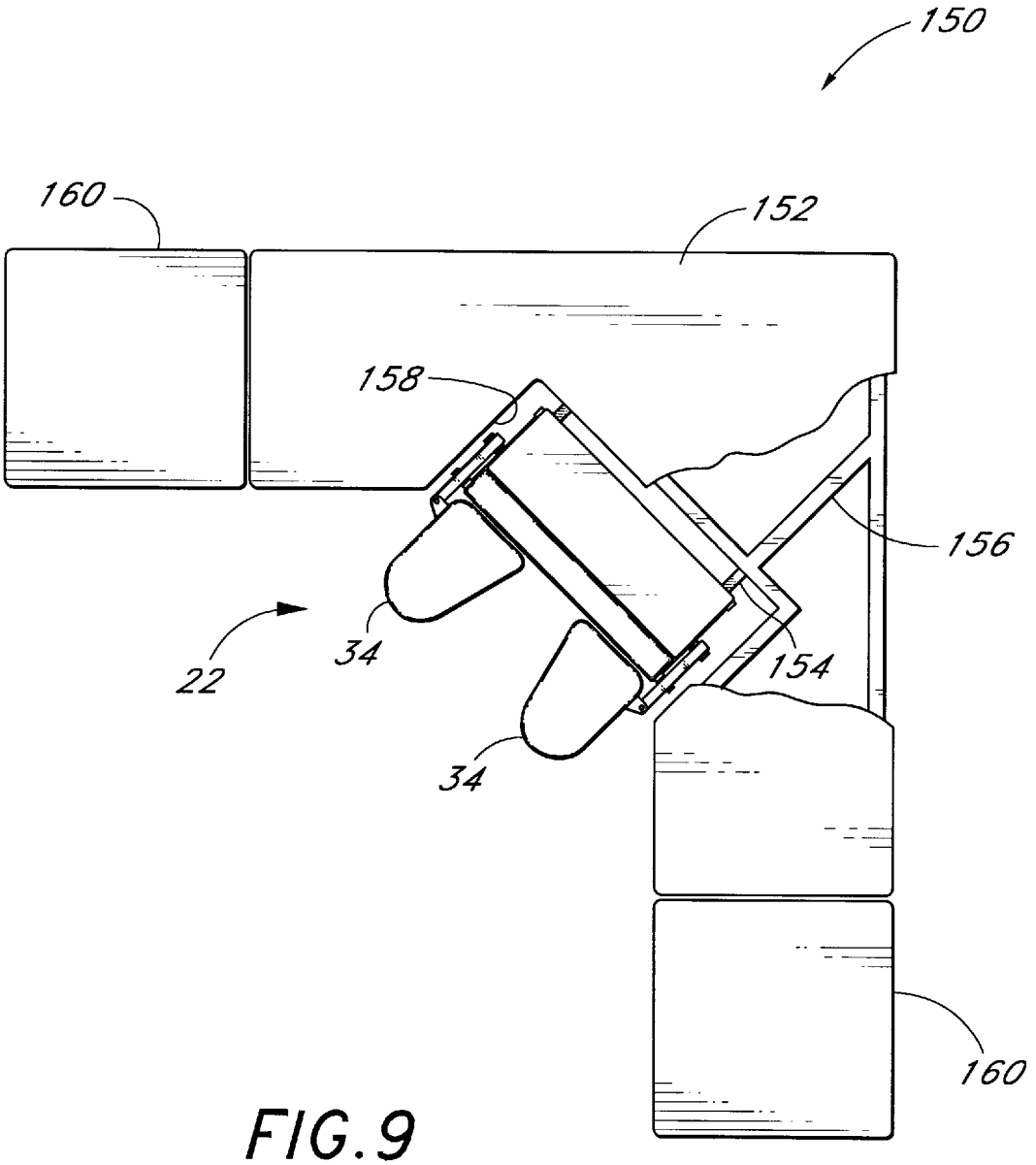
FIG. 9 is a top plan view of a further corner desk workstation incorporating the upper body support apparatus of the present invention.

As shown in FIG. 9, a further alternative workstation 150 is shown. The workstation 150 is shown in plan view with a portion 158 of a central desk 152 cutaway to expose the structure frame members underneath. In this version, the upper body support apparatus 22 includes a pair of rearwardly extending members 154 which fit within tubular frame members 156 of the workstation 150. The members 154 can be rigidly attached to frame members 156 or can be slidable therein to enable removal of the upper body support apparatus 22. This configuration may be replaced by a more rigid structure, such as in the workstation 130 of FIG. 8. The main body 152 of the workstation 150 is formed in a right angle with a central cutout 158 for accommodating the upper body support apparatus 22. A pair of end extensions 160 can be added to increase the desktop area of the workstation 150, as was described for the side extensions 140 of FIG. 8. Again, the armrests 34 can be slid outward and pivoted as was described for the first embodiment of FIGS. 1–5.

It will now be apparent to the reader that the present system, whether embodied in a standalone version 20 or into autonomous workstations, provides an extremely sturdy upper body support for a user. The provision of the forwardly extending feet and desk extensions provide an anti-tip support structure which allows one to place his or her entire weight on the armrests of the invention without fear of the device tipping forward, as contrasted with previous add-on devices of the prior art. A further primary advantage of the present invention is the ability to vertically adjust the armrests and keyboard platform to suit the individual user. Once the optimum height of the upper body support apparatus is fixed, the user may then adjustably position the armrests to their individual width. Finally, the system provides a planar support surface for the user's arm extending from the elbow all the way to the fingers. Such comprehensive, sturdy support for a user such as a keyboard operator will help prevent the occurrence of repetitive strain injuries.

Standalone Workstation with Central Mouse Pad and Optional Side Table

Figure 10:
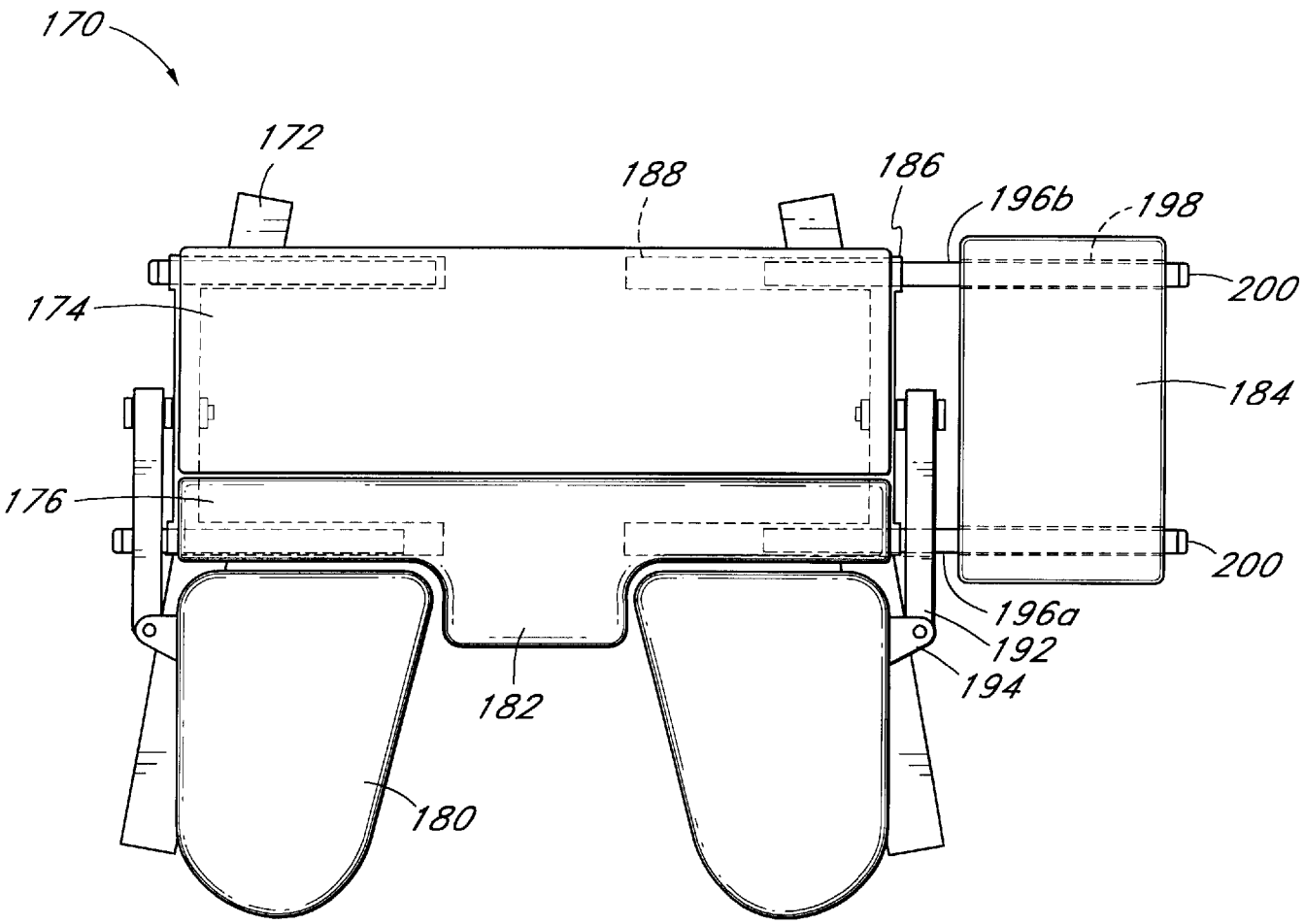
FIG. 10 is a top plan view of an alternative embodiment of the standalone upper body support system incorporating a central mouse pad and optional side table.

FIG. 10 illustrates an alternative embodiment of a standalone workstation 170 in many ways similar to the system 20 shown in FIG. 1 but with several functional changes. The workstation 170 comprises the lower legs 172 having upright tubular stanchions (not shown) attached thereto and supporting a generally horizontal subframe (not shown but similar to the subframe 36 described for FIG. 1). The subframe supports a keyboard platform 174, a wrist pad 176 and a pair of armrest support assemblies 178 for a pair of armrests 180.

The wrist pad 176 is generally constructed in an identical manner to the wrist pad 38 described previously, and preferably includes a rigid base fixedly attached to the horizontal subframe and an upper cushion comprising a foam-filled vinyl pad. The previously described wrist pad 38 was positioned at the front edge of the subframe 36 and extended the entire width of the subframe. The front-to-back dimension of the wrist pad 38 is three or four inches, or approximately one-quarter of the full front to back dimension of the subframe 36.

The alternative wrist pad 176 shown in FIG. 10, on the other hand, includes the main transverse body portion extending the entire width of the subframe and also has a central forwardly extending mouse pad 182 adjacent the armrests 180. This mouse pad extension 182 extends forwardly a distance approximately equal to the front-to-back distance of the main body portion of the wrist pad 176. In a preferred embodiment, the mouse pad extension 182 is unsupported by the subframe and is formed as an integral unit with the main body portion of the wrist pad 176. Other arrangements are possible, however, such as a longer forwardly extending mouse pad extension fully supported underneath by the subframe, or an extension which is manufactured as a separate piece from the main body portion of the wrist pad but of similar construction so that when the two components are juxtaposed they define a planar upper surface. Desirably, the mouse pad extension 182, wrist pad 176 and armrests 180 are configured to provide coplanar upper support surfaces which combine to form a continuous platform for the entire wrist, forearm and upper body of the operator.

The alternative standalone workstation 170 further includes an optional side table 184 capable of being positioned on either side of the subframe. Each armrest support assembly 178 comprises a U-shaped frame 186 defined by a pair of transversely extending frame legs 188 and a central connecting portion 190. The U-shaped frame 186 is slidable transversely within the horizontal subframe, as was previously described. A rigid linkage bar 192 is pivotably connected to the connecting portion 190 to rotate about a horizontal axis relative thereto. The linkage bar 192 is also rotatably coupled at its other end to an armrest support bracket 194 which is rigidly attached to the armrest 180. The entire armrest support assembly 178 is thus substantially identical to the armrest support assembly 46 as previously described.

In a divergence from the previous armrest support assembly 46, the alternative support assembly 178 includes a pair of elongated sliding members or side table support bars 196*a*, 196*b* which extend transversely through side apertures into the U-shaped frame legs 188. The front sliding member 196*a* functions as a catch member to support the linkage bar 192 and armrest 180, in a similar manner to the previously described catch member 58. In addition, the front and rear sliding members 196*a,b* may be extended transversely outward relative to the U-shaped frame 186 to provide coplanar supports for the side table 184. It is contemplated that a positive lock may be provided for each sliding member 196 to fix its transverse position with respect to the U-shaped frame 186. Such a lock may be a set screw arrangement, a pin in cooperation with a series of holes in the sliding members 196, or other such structures well known in the art.

The side table 184 may be configured in any number of ways for various applications but is preferably, in the simplest embodiment, a separate flat platform, padded or otherwise, with a pair of transverse stabilizer rails 198 extending vertically downward underneath. The stabilizer rails 198 are spaced apart a sufficient distance to extend on either side of the sliding support members 196. In this manner, the side table 184 is prevented from forward or rearward movement. Furthermore, the sliding support members 196 are provided with upwardly extending end tabs 200 which prevent the side table 184 from sliding outwardly past the ends of the sliding support members 196, and also to prevent the sliding members from sliding completely into the tubular U-shaped frame legs 188. The tab 200 on the front sliding support member 196*a* also abuts against the linkage bar 192 when the front sliding member 196*a* functions as a catch member. In the preferred embodiment, there are two pairs of sliding support members 196 provided so as to be able to position the side table 184 on either side of the workstation 170. If preferred, the side table 184 can be removed completely and the sliding members 196 retracted fully into the U-shaped frames 186.

Workstation Configured For Use With Existing Furniture

Figure 11A:
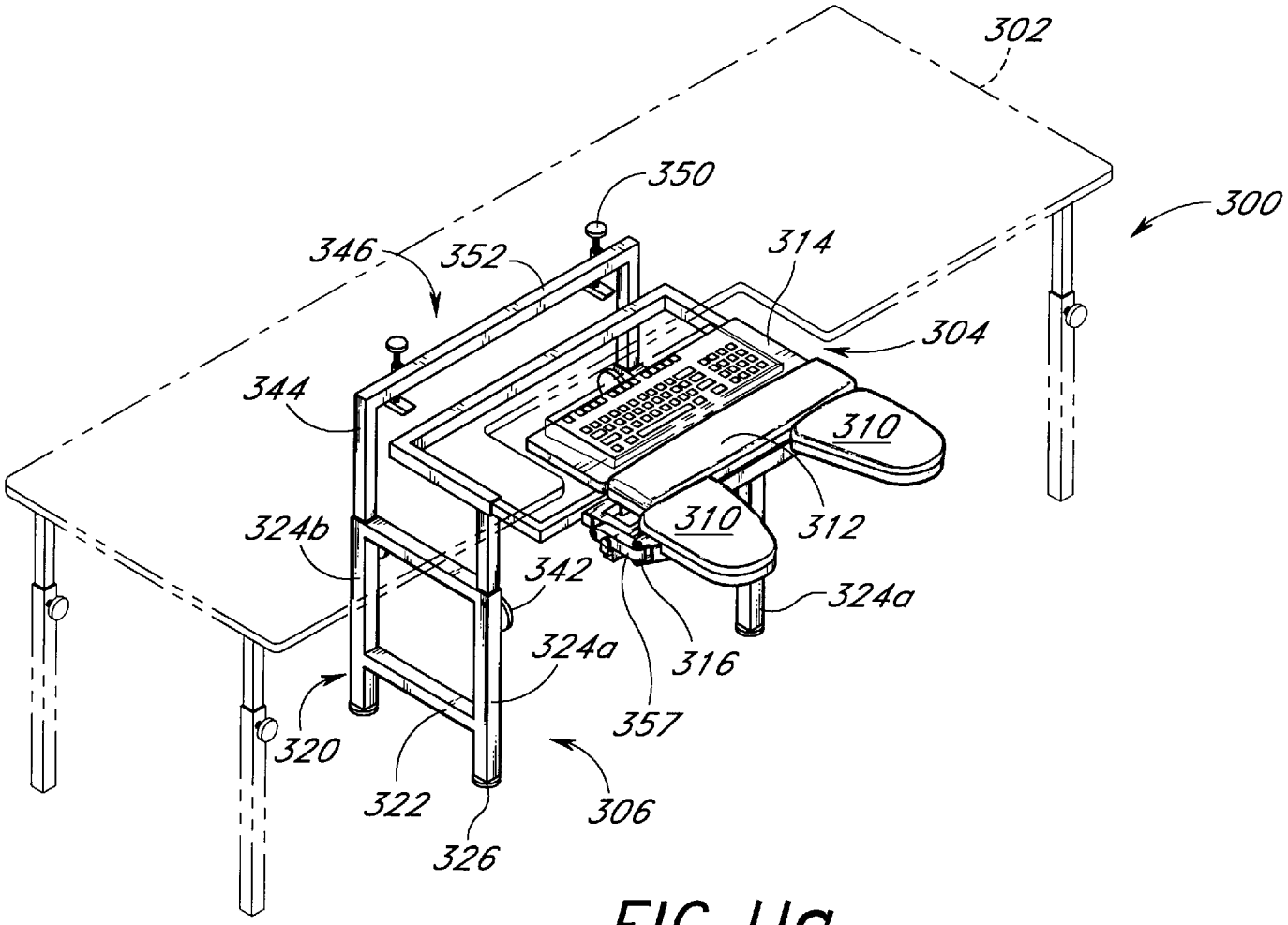
FIG. 11*a* is a perspective view of a fourth embodiment of the upper body support system that is configured to be used in conjunction with an existing piece of furniture.

FIG. 11*a* illustrates another embodiment of an upper body support system or assembly 300 that is configured to be used in conjunction with an existing piece of furniture 302. In the embodiment shown in FIG. 11*a*, the existing piece of furniture 302 is an adjustable table, however, it will be appreciated from the following discussion that the support assembly 300 can be used in conjunction with any of a number of different types of furniture including counters, desks, and the like.

In the embodiment shown in FIG. 11*a*, the upper body support assembly 300 is comprised of an upper body support apparatus 304 which is mounted on a height adjustable stand 306. The upper body support apparatus 304 includes two armrests 310, a wrist pad 312 and a work platform 314 which, in this embodiment, is configured to receive a computer keyboard. The armrests 310 and wrist pad 312 are similar in construction and operation to the armrests and wrist pad described hereinabove in reference to FIG. 1. Specifically, the armrests 310 are pivotally attached to a sub-frame 316 so as to be rotatable downward into a storage configuration. The sub-frame 316 will be described in greater detail in reference to FIG. 11*b*.

The height adjusting stand 306 is comprised of two generally rectangular support frames 320 (one fully shown). The support members 320 include two horizontal supports 322 extending between two vertical stanchions 324 and two feet members 326 positioned at the bottom of the two vertical stanchions 324. The forward stanchion 324*a* is configured to receive a vertical support member 340 which supports the upper body support apparatus 304. The vertical support member 340 is slidably engaged inside of the vertical stanchion 324*a* and is secured at a desired height by a height adjusting knob 342 in the manner that was previously described in reference to FIG. 3.

Each rear stanchion 324*b* is configured to slidably receive a vertical portion 344 of a counter-balance member 346. The vertical portions of the counter-balance member 346 are slidably engaged inside of the vertical stanchions 324*b* so that the counter-balance member 346 can be vertically adjusted in substantially the same fashion as the height adjusting stand 306. Two adjustable stops 350 are mounted on a horizontal portion 352 of the counter-balance member 346. The stops 350 and the counter-balance member 346 are both vertically adjustable so that the stops 350 can be positioned immediately adjacent, and preferably in contact with, the underside of the furniture 302 (FIG. 11*a*). The piece of furniture 302 is preferably heavy enough, or is fixedly attached to the floor, so that the weight of the piece of furniture 302 counter-balances the weight of the person resting their upper body on the support apparatus to prevent tipping. Both the forward stanchions 324*a* and the rear stanchions 324*b* preferably include either the spring apparatus shown in FIG. 3*a* or the piston apparatus shown in FIG. 3*b* to aid the user in adjusting the height of the support apparatus 304 and the counter-balance member 346. It can be appreciated that the support system 300 is configured so that the tendency of the support system 300 to tip as a result of a user resting their body weight upon the armrests 310 and wrist support 312 is counter-balanced by the weight of the piece of furniture 302 on the vertical stops 350 and the counter-balance member 346.

Figure 11B:
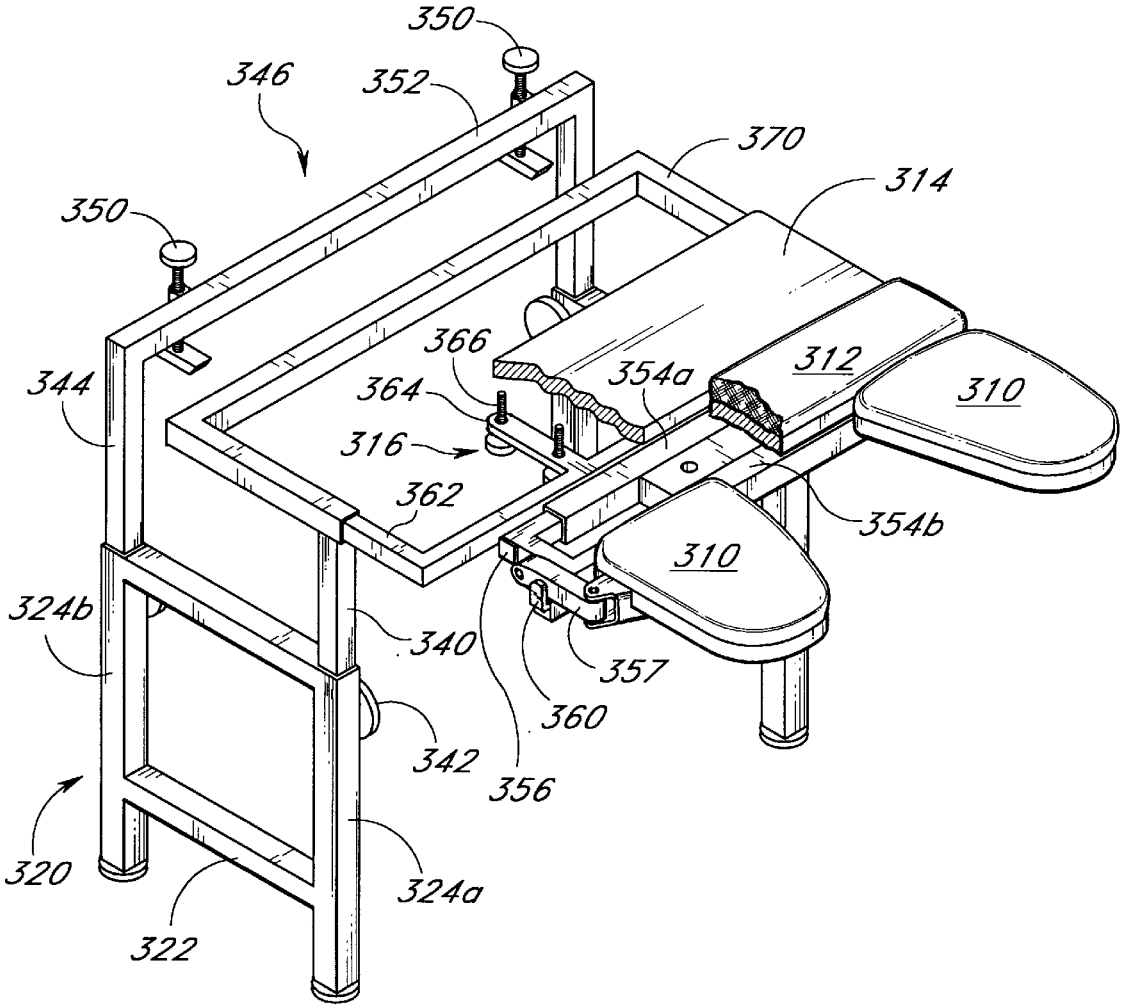
FIG. 11*b* is a detailed perspective view illustrating the embodiment of the upper body support system shown in FIG. 11*a;*

FIG. 11*b* is partially cutaway to more clearly illustrate the components of the sub-frame 316. The sub-frame 316 includes two transverse tubular members 354*a*, 354*b* that are configured to receive two U-shaped frames 356 (one shown) on which the armrests 310 are mounted in substantially the same manner as described hereinabove. As is shown in FIG. 11*b* and 11*c*, the armrests 310 are mounted on pivoting arms 357 which are pivotally attached to the U-shaped frames 356 so as to be rotatable about the ends of the frame and each frame 356 includes a catch 360 that maintains the armrest 310 in a position such that the user can rest his or her arms on the armrests 310 while engaged in activity on the platform 314.

Preferably, the two transverse tubular members 354*a*, 354*b* are attached to a generally U-shaped platform frame 362. The platform frame 362 includes two struts 364 (one shown) which are preferably co-planar with the upper surface of the frame 362 and extend inwardly toward the rear of the assembly 300. The two struts 364 are configured to receive two screws 366 which extend through the strut 364 and couple to the underside of the platform 314 to secure the platform on the frame 362. The U-shaped platform frame 362 is slidably engaged with a U-shaped receiving frame 370 that is, in turn, welded to the two vertical support members 340 (one shown). It can be appreciated that, when a user rests their entire upper body weight on the armrests 310, the bending force that is applied to the U-shaped platform frame 362 is significant. Hence, in the preferred embodiment, the sections of the U-shaped frame 362 that are slidably positioned within the U-shaped receiving frame 370 are as long as the receiving sections 372 of the receiving frame 370 to minimize the possibility that the U-shaped frame 356 will bend.

Figure 11C:
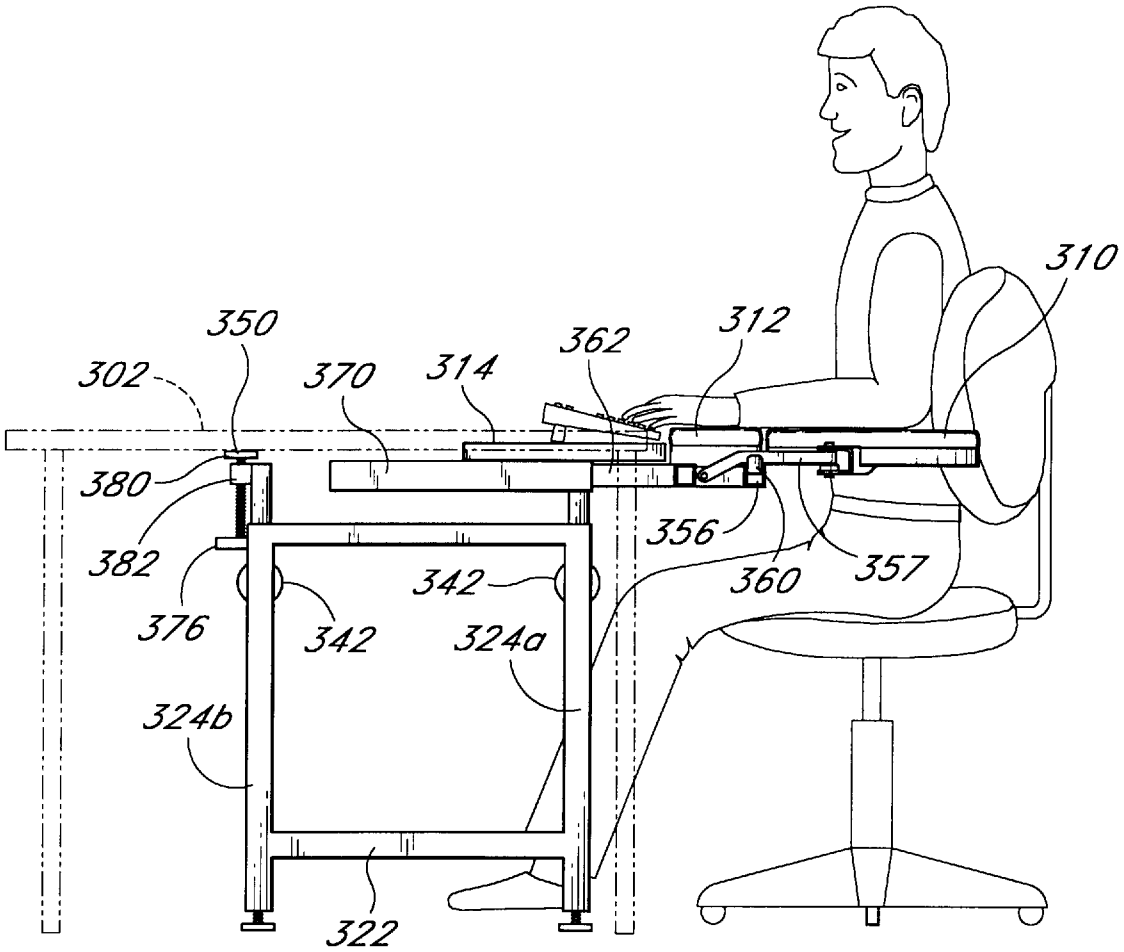
FIG. 11*c* is a side elevational view of the embodiment shown in FIG. 11*a;*

Referring now to FIG. 11*c,* the features of the stop 350 are more clearly shown. The stop 350 is essentially comprised of a screw 374 that, on the bottom end, has a handle 376 and, on the top end, has a circular disk 380 which is preferably made of a material such as rubber which will not mar the surface of the piece of furniture 302. The screw is preferably captured in a bracket 382 which is attached, and preferably welded, to the horizontal portion 352 of the counter-balance member 346. Only one of the stop assemblies 350 is shown in FIG. 11*c,* however, reference to FIGS. 11*a* and 11*b* illustrate that the two stop assemblies 350 are preferably located adjacent the ends of the horizontal portion 352 of the counter-balance member 346.

The user preferably locates the assembly 300 underneath the piece of furniture 302 so that the armrests 310 extend outward from the piece of furniture 302 a desired distance. The user then turns the screws 374, using the handles 376, so that the circular disk 380 comes in contact with the underside of the piece of furniture 302. It can be appreciated that, when the user rests his or her upper body weight on the armrests 310, the assembly 300 has a tendency to tip, i.e., pivot about the forward vertical stanchions 324*a.* However, the weight of the furniture 302 on the circular disks 380 has a tendency to counteract the tendency of the system 300 to tip or pivot about the forward vertical stanchions 324*a* in the same manner as described above. It can be appreciated that the piece of furniture 302 will preferably be of sufficient weight to prevent the system 300 from tipping or that the piece of furniture 302 will be anchored on the floor.

Hence, FIGS. 11*a*–11*c* illustrate another embodiment of a support system 300 that is configured to be used with existing pieces of furniture 302. The existing piece of furniture can be used to counter-balance the system 300 to prevent it from tipping when the user rests his or her upper body weight on the armrests 310. This configuration of the upper body support system obviates the need for the diverging feet 26 incorporated into the embodiment of FIG. 1. Thus, the embodiment of FIGS. 11*a*–11*c* provide better and easier access to the piece of furniture 302 and the working platform 314 for a user who is either in a wheelchair or who is in a standard office chair that rolls across the floor.

Figure 12A:
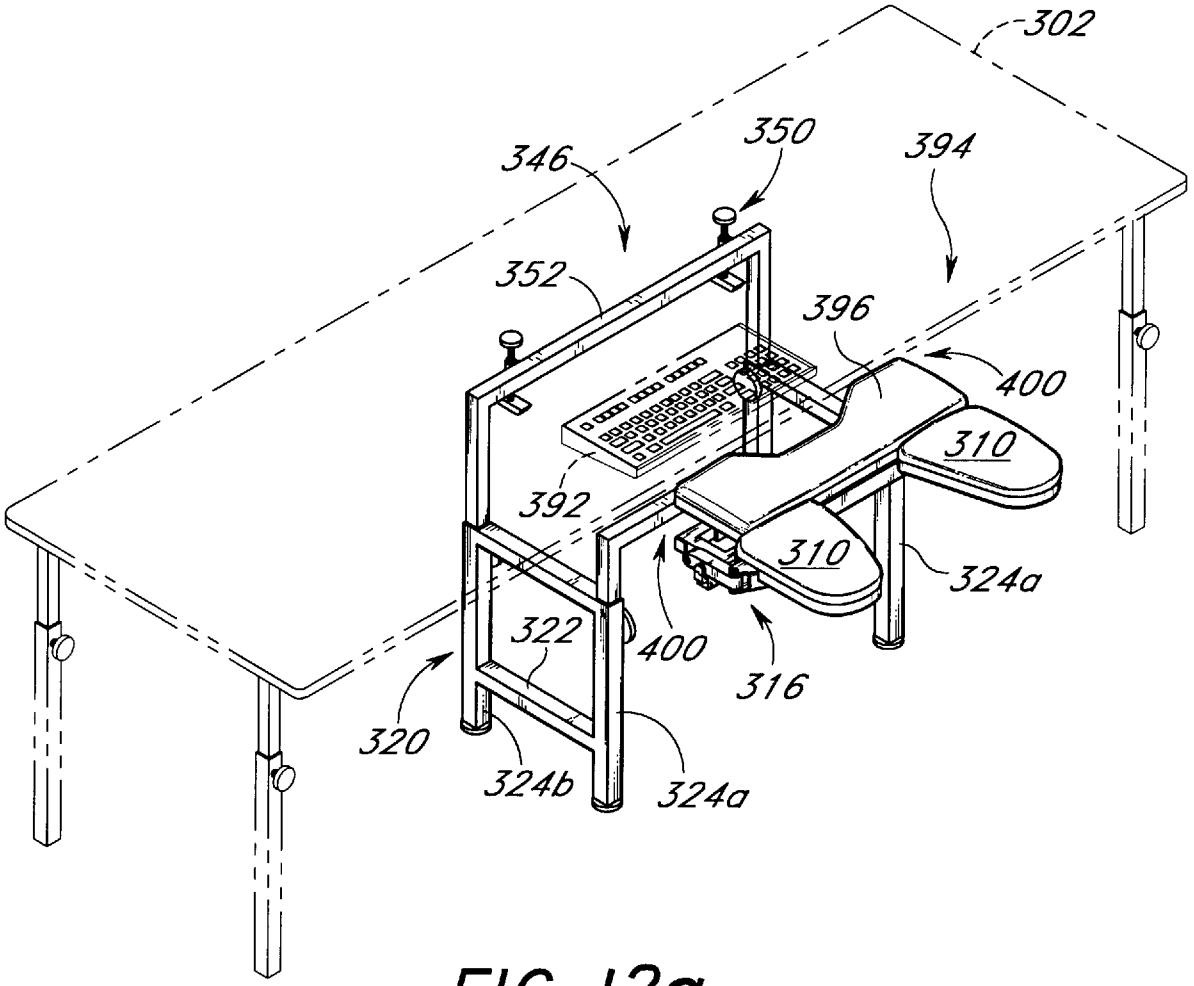
FIG. 12*a* is a perspective view of a fifth embodiment of the upper body support system that is also configured to be used in conjunction with an existing piece of furniture.
Figure 12B:
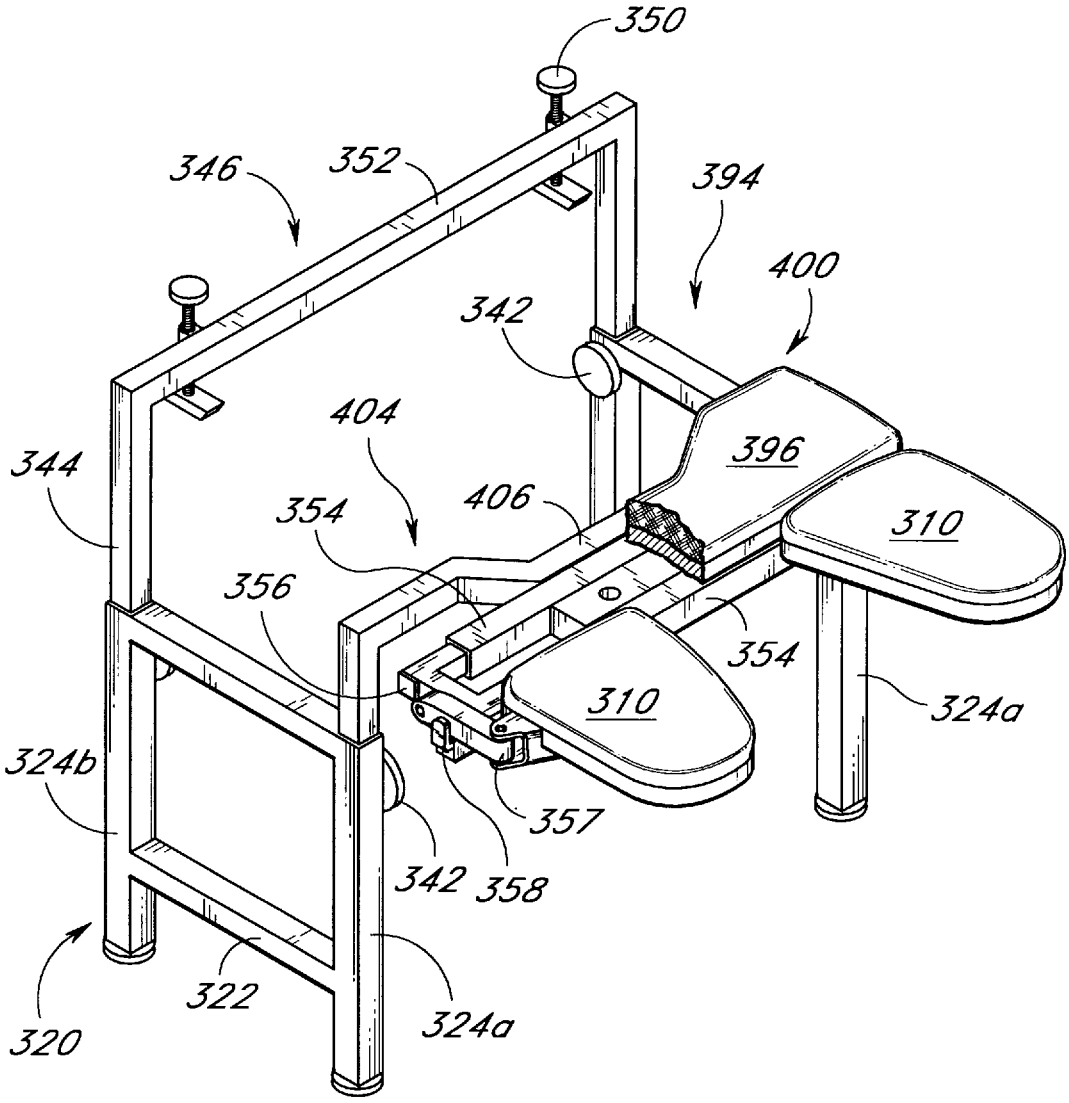
FIG. 12*b* is a detailed perspective view illustrating the embodiment of the upper body support assembly shown in FIG. 12*a;*
Figure 12C:
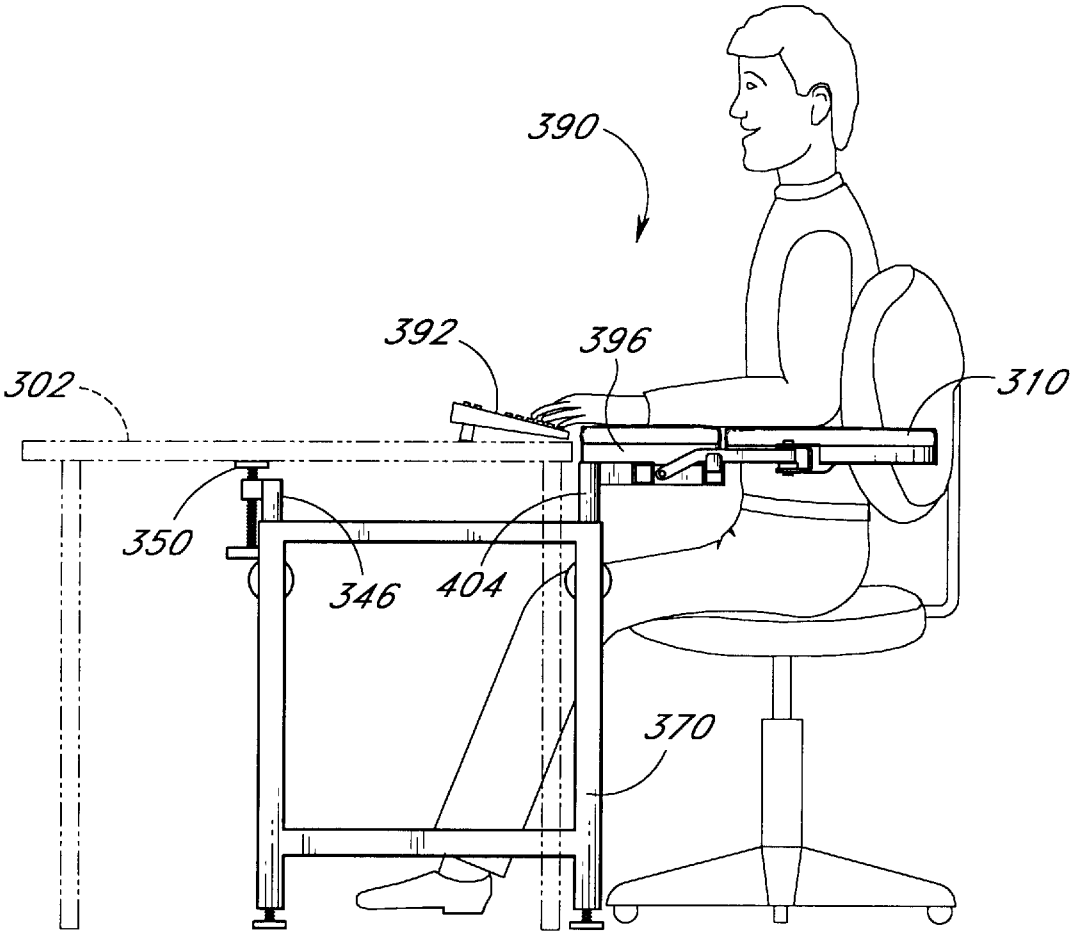
FIG. 12*c* is a side elevational view of the embodiment shown in FIG. 12*a;*

Workstation Configured For Use With Existing Furniture wherein Existing Furniture Provides A Working Platform FIGS. 12*a*–12*c* illustrate another embodiment of a support assembly 390 which is similar to the embodiment shown in FIGS. 11*a*–11*c,* with the exception that no working platform 314 is provided on the support assembly 390. Specifically, referring initially to FIG. 12*a,* the piece of furniture 302 provides the working platform upon which the object to be worked on by the user is positioned. In FIG. 12*a,* the object is a keyboard 392, however, it will be appreciated that any of a number of different objects which require continuous repetitive activity by the user can also be positioned on the furniture 302, thereby allowing the user to make use of the support assembly 390 for upper body support while working on the object. For example, the piece of furniture 302 can be configured as an assembly station wherein the user assembles mechanical or electrical components.

FIGS. 12*a*–12*c* illustrate that the support assembly 390 incorporates many of the same features as the support system 300 illustrated in FIGS. 11*a*–11*c.* Specifically, the support system 390 includes two generally rectangular support frames 320 which include two vertical stanchions 324 wherein the forward vertical stanchions 324*a* receive a vertical support member 340 that supports an upper body support apparatus 394. Further, the rear vertical stanchions 324*b* of the two support frames 320 each receive the vertical portions 344 of the counter-balance member 346. Two stop assemblies 350 are mounted on the counter-balance member 346 in the previously described manner and the counter-balance member 346 is used in conjunction with the piece of furniture 302 to prevent tipping of the system 390 in the same manner as described above in reference to FIG. 11*c.*

The primary difference between the embodiment shown in FIGS. 12*a*–12*c* and the embodiment shown in FIGS. 11*a*–11*c* is that there is no working platform 314 mounted on the system 300. Since the object that the user is to be working on is positioned on the surface of the piece of furniture 302, a modified wrist support 396 has been incorporated into the upper body support apparatus 394. Specifically, the modified wrist support 396 includes two extended portions 400 located at the outer ends of the wrist support 396 that extend toward the surface of the piece of furniture 302. The extended portions 400 provide additional support for the user's wrists as the user is reaching onto the table to work on the keyboard 392.

FIG. 12*b* is partially cutaway to illustrate the sub-frame 402 that supports the wrist supports 394 and the arm supports 310 of the support apparatus 394. The sub-frame 402 includes two transverse tubular members 354 which receive the U-shaped frame 356 on which the pivoting arms 357 supporting the armrests 310 are mounted. The sub-frame 402 also includes the catch 360 which holds the pivoting arm 357 in the raised position shown in FIG. 12*b.* The two transverse tubular members 354 are fixedly attached to a horizontal support member 404. The horizontal support member 404 is integrally connected to the vertical support member 340 at either end and is thus supported at a desired height by the height adjusting knobs 342. The horizontal support member 404 is preferably made out of rectangular metal tubing and preferably has a projecting portion 406 wherein the member 404 is bent so as to project outward from the edge of the piece of furniture 302. The sub-frame 316 of the apparatus 394 is preferably attached to the projecting portion 406 of the horizontal support member 404 either by bolts or by welds or some combination thereof.

Preferably, the square support frames 320 are positioned underneath the piece of furniture 302 to minimize the amount of usable space occupied by the system 390. It can be appreciated, however, that at least a portion of the horizontal support member 404 must project outward from underneath the piece of furniture 302 to allow the sub-frame 316 to be attached thereto so that the wrist support 396 and the armrests 310 are positioned adjacent the edge of the piece of furniture 302.

FIG. 12*c* illustrates how the support system 390 is preferably used. The support system 390 is initially positioned underneath the piece of furniture 302. The user then raises the support apparatus 394 to a desired level and secures the support apparatus 394 in this level by tightening the height adjusting knobs 342. Preferably, the support apparatus 394 is raised to a level wherein the extended portions 400 (FIG. 12*b*) of the wrist support 396 are at substantially the same vertical height as the edge of the upper surface of the piece of furniture 302 so that the user's arms and wrists are continuously supported along their entire length in the manner shown in FIG. 12*c*. The user also adjusts the counter-balance member 346 and the stop assemblies 350 to a level where the stop assemblies 350 are positioned immediately adjacent, and preferably in contact with, the underside of the piece of furniture 302.

Hence, the embodiment shown in FIGS. 12*a*–12*c* provides support for a user's upper body, including his or her arms, wrists and hands while the user is working on an object, e.g., a keyboard, that is positioned on the surface of a piece of furniture. As with the embodiment of FIGS. 11*a*–11*c*, the embodiment shown in FIG. 12*a*–12*c* is configured to use the piece of furniture to prevent tipping of the support system.

Movable Workstation Configured For Use With Existing Furniture

Figures 13A, 13B:
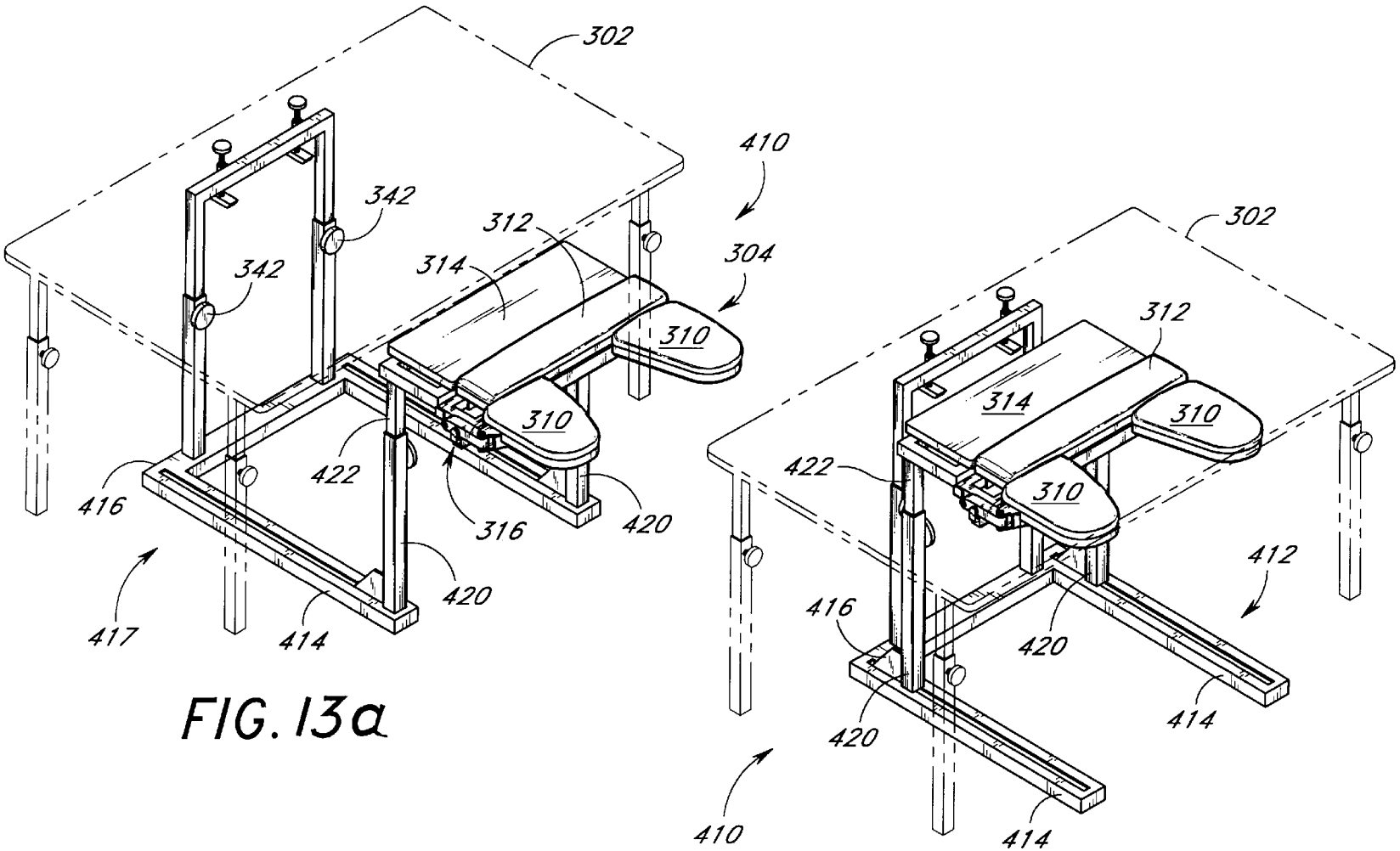
FIGS. 13*a*–13*b* are perspective views of a sixth embodiment of the upper body support assembly that is configured to be used in conjunction with an existing piece of furniture and is further configured to be slid underneath the piece of furniture when not in use.

FIGS. 13*a*–13*d* illustrate yet another embodiment of a support system 410 of the present invention. The support system 410 in this embodiment includes a support apparatus 304 that is substantially identical to the support apparatus 304 described in reference to FIGS. 11*a*–11*c* above. However, this embodiment of the support system 410 is configured so that the support apparatus 304 is movable between a first position, wherein the support apparatus 304 can be used by a user (FIG. 13*a*), and a second position, wherein the support apparatus is positioned underneath the piece of furniture 302 for storage (FIG. 13*b*).

Figure 13C:
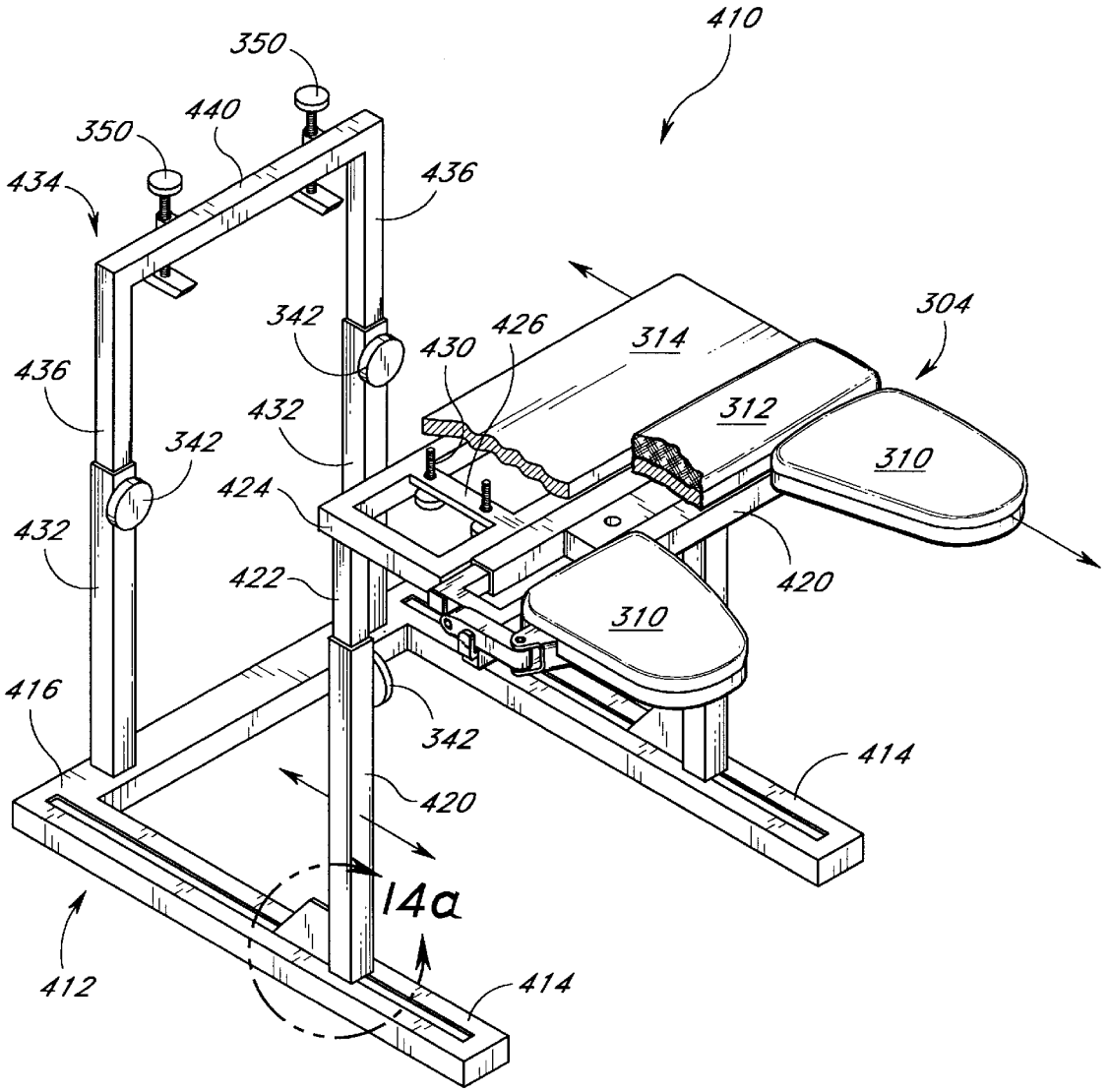
FIG. 13*c* is a detailed perspective view of the embodiment of the upper body support assembly shown in FIGS. 13*a,* 13*b;*

As is shown more clearly in FIG. 13*c*, the system 410 includes a U-shaped support frame 412 that is positioned on the ground or floor. The U-shaped support frame 412 includes two parallel track sections 414 interconnected by a transverse support section 416. The two parallel track sections 414 are configured so that two vertical support stanchions 420 are movable along the track sections 414.

Positioned within the vertical support stanchion 420 is a vertical support member 422. The vertical support stanchion 420 is preferably comprised of a hollow rectangular tube of metal and the vertical support member 422 is preferably comprised of a hollow rectangular tube of metal that fits within the stanchion 420. The vertical support stanchion 420 is substantially similar in construction to the stanchions 28 described in reference to FIGS. 3, 3*a* and 3*b* hereinabove and include either of the support apparatus illustrated in FIG. 3*a* and 3*b* to aid the user in moving the vertical support member 422 to a desired height. Height adjusting knobs 342, similar to the knobs described hereinabove, are also provided on the stanchions 420 to maintain the vertical support member 422 at the desired height.

The vertical support members 422 are connected to a work platform support frame 424 whereupon the work platform 314 is mounted. Specifically, the support frame 424 includes two cross-pieces 426 (one shown in FIG. 13*c*) which have two screws 430 projecting therethrough that attach to the underside of the work platform 314. The sub-frame 316 of the support apparatus 304 is then attached to the support frame 424. Hence, the armrests 310, the wrist support 312 and the work platform 314 are mounted on the vertical support member 422 that is positioned within the movable vertical stanchions 420. This allows the support apparatus 304 to be moved outward from and inward towards the piece of furniture 302.

Two counter-balance stanchions 432 are also mounted on the transverse section 416 of the support frame 412. The counter-balance stanchions 432 are similar in construction to the vertical support stanchions 420 described above. The counter-balance stanchions 432 are configured to receive two vertical sections 436 of a counter-balance member 434. The counter-balance member 434 includes a horizontal section 440 extending between the two vertical sections 436 of the counter-balance member 434. Two stop assemblies 350, similar to the stop assemblies described hereinabove in reference to FIG. 11*c*, are mounted on the horizontal section 440. The counter-balance member 434 serves the same purpose as the counter-balance member 346 described hereinabove in reference to FIGS. 11*a*–11*c* in that it prevents tipping of the system 410 as a result of the user resting his or her upper body weight on the support apparatus 304.

Figure 13D:
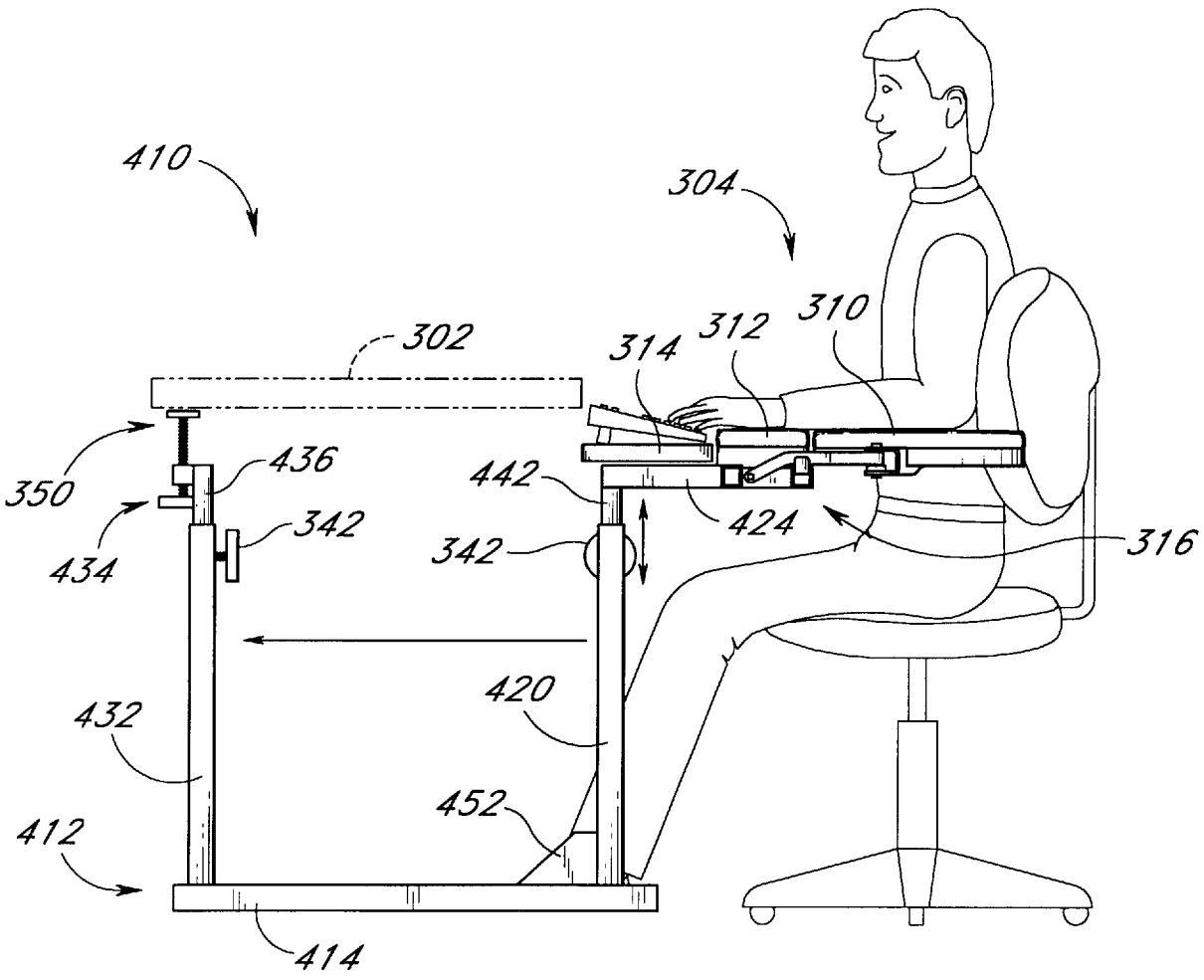
FIG. 13*d* is a side view of the embodiment of the upper body support assembly shown in FIG. 13*c;*

FIG. 13*d* illustrates that stop assemblies 350 and the counter-balance member 434 are positioned immediately adjacent the underside of the piece of furniture 302 so as to prevent tipping of the system 410 as a result of the user resting his or her upper body weight on the upper body support apparatus 304. Further, FIG. 13*d* illustrates that the user can move the upper body support apparatus 304 underneath the piece of furniture 302. This is accomplished by first manipulating the height adjusting knobs 342 and lowering the support apparatus 304 so that it is lower than the upper surface of the piece of furniture 302. The user can then slide the movable stanchions 420 along the track section 414 to thereby position the support apparatus 304 underneath the piece of furniture 302 in the storage configuration shown in FIG. 13*b*.

Figure 14A:
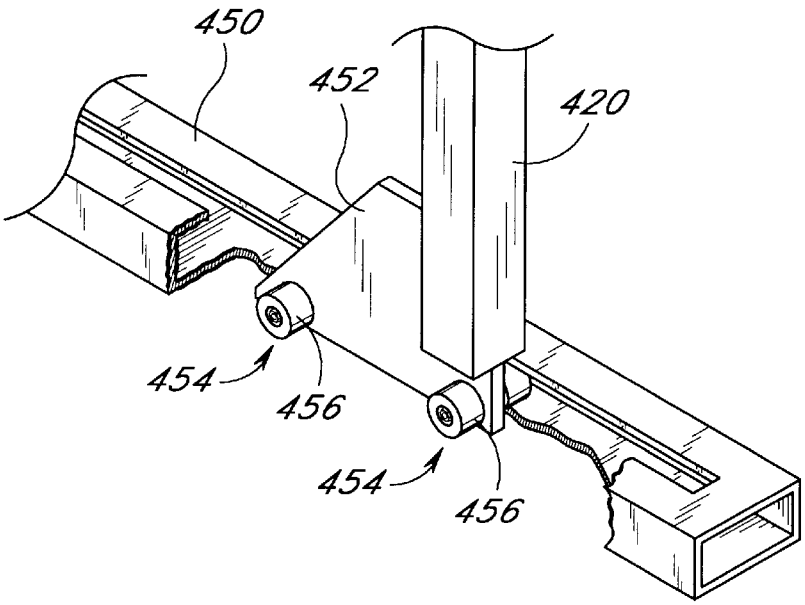
FIG. 14*a* is a detail of the rolling assembly of the embodiment shown in FIG. 13*c,* that allows the assembly to be moved under a piece of furniture when not in use.
Figure 14B:
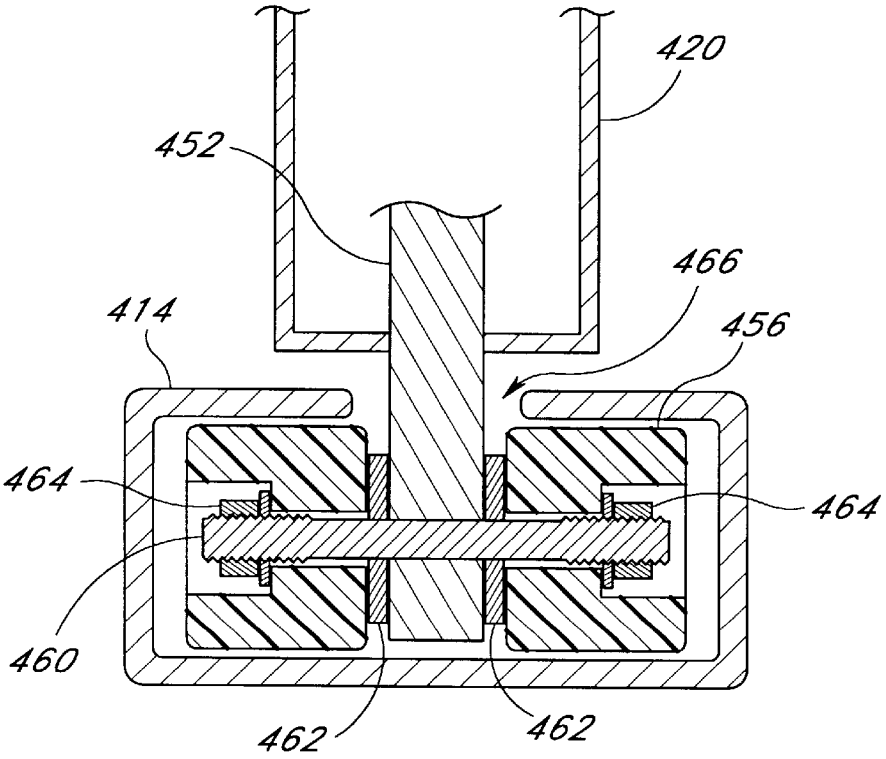
FIG. 14*b* is a cutaway view of the rolling apparatus shown in FIG. 14*a.*

FIGS. 14*a* and 14*b* further illustrate a sliding mechanism 450 that is attached to the bottom side of each of the vertical support stanchions 420. The vertical support stanchion 420 is connected to a roller mount 452. Preferably, the vertical support stanchion 420 is either welded to or integrally formed with the roller mount 452 as it will be understood that the connection between these two elements must be sufficiently strong to withstand continuous force exerted by the user on the upper body support apparatus 304. Two roller assemblies 454 are mounted at either end of the roller mount 452.

The roller assemblies 454 include roller wheels 456 mounted on both sides of the roller mount 452 in the manner shown in FIG. 14*b*. The roller assemblies 454 also include an axle 460 which extends through the roller mount 452 and two washers 462 mounted between the roller wheels 456 and the roller mount 452. Preferably, the axles 460 are threaded at either end so that a locknut 464 can be mounted at either ends of the axle 460 to retain the roller wheels 456 on the axle 460. It will be understood that bearings and similar devices used to permit rolling engagement between the roller wheels 456 and the axle 460 may also be included in the roller assembly 454.

Both the track sections 414 of the U-shaped support frame 412 are preferably comprised of rectangular metal tubing that includes a longitudinal opening 466 that extends substantially along the full length of the track section 414. The width of the longitudinal opening 466 is preferably only slightly greater than the thickness of the roller mount 452. As shown in FIG. 14, the interior of the track sections 414 are configured to receive the roller assemblies 454 and to guide the assemblies along a track defined by the interior of the track sections 414. Since both the track sections 414 are parallel and the vertical stanchions 420 are each equipped with the above-described sliding mechanism 450, it can be appreciated that the vertical stanchions 420 can be simultaneously moved longitudinally along the track sections 414 thereby allowing the support apparatus 304 to be positioned underneath the piece of furniture 302 in the manner shown in FIG. 13*b* hereinabove. It can also be appreciated that the sliding mechanism described hereinabove in reference to the embodiment of the support system shown in FIGS. 13*a*–13*d* can also be readily adapted to other previously described embodiments with a minimum of alteration of the previously described embodiments.

SUMMARY

The foregoing description disclosed multiple embodiments of an upper body support system that provides support for users who are engaged in repetitive tasks such as typing. Some of these embodiments are adapted to be used in conjunction with existing pieces of furniture and are specifically adapted to use the existing pieces of furniture as a counter-balance to the weight of the user's upper body to prevent tipping of the system. Further, some of these embodiments can also be adapted so that they can be positioned underneath an existing piece of furniture in a storage configuration when not in use.

Although this invention has been described in terms of certain preferred embodiments, other embodiments that are apparent to those of ordinary skill in the art are also within the scope of the invention. Accordingly, the scope of the invention is intended to be defined only by reference to the appended claims.

What is claimed is:

1. A support assembly for use with a piece of furniture having a first surface comprising:

a support frame positioned on the floor and having at least one upwardly extending member;

a horizontally extending subframe coupled to the upwardly extending member;

at least one armrest attached to said subframe so as to be supported adjacent a front side of said assembly, wherein said armrest and said subframe are configured to provide support for a portion of said user's body when said user is positioned adjacent said front side of said assembly and is using at least one hand to engage in manual activities on a work surface positioned adjacent said armrest; and a counter-balance member coupled to said support frame said counter balance member being dimensioned to bear against said first surface of said piece of furniture so that said piece of furniture reduces the tendency of said assembly to tip as a result of said user making use of said armrest.

2. The assembly of claim 1, wherein said upwardly extending member is coupled to said support frame so as to be vertically adjustable.

3. The assembly of claim 1, wherein said at least one armrest comprises two armrests that are coupled to said subframe so that said armrests are horizontally adjustable.

4. The assembly of claim 1, wherein said at least one armrest is pivotally connected to said subframe so that said at least one armrest can be positioned either in a support position wherein said armrest extends generally horizontally and thereby supports said user's arm or in a storage configuration wherein said at least one armrest is positioned generally vertically.

5. The assembly of claim 1, wherein said counter-balance member bears against a lower surface of said piece of furniture and said assembly is dimensioned so as to be positioned relative said work surface so that said at least one armrest is positioned adjacent an edge of said lower surface.

6. The assembly of claim 5, wherein said support frame is dimensioned so as to be positioned substantially underneath said lower surface of said piece of furniture and said counter-balance member is positioned adjacent the underside of said lower surface.

7. The assembly of claim 6, further comprising at least one stop assembly, which includes a stop, mounted on said counter-balance member, wherein said stop assembly is adjustable so that said stop can be positioned in contact with said lower surface.

8. The assembly of claim 6, wherein said counter-balance member is adjustably coupled to said support frame so as to be vertically adjustable relative to said floor.

9. The assembly of claim 1, further comprising a work platform mounted on said subframe.

10. The assembly of claim 9, further comprising a wrist support mounted on said subframe and interposed between said work platform and said at least one armrest.

11. The assembly of claim 10, wherein said work platform is configured to receive a keyboard.

12. The assembly of claim 1, wherein said support frame includes a track section and said upwardly extending member is movably engaged with said track section so that said subframe and said armrest can be moved toward and away from said piece of furniture.

13. The assembly of claim 12, wherein said assembly is dimensioned so that said support frame is positioned on said floor underneath said lower surface of said piece of furniture so that said armrest and said subframe can be positioned underneath said horizontal surface of said piece of furniture when not in use.

14. The assembly of claim 13, wherein said upwardly extending member is coupled to said support frame so as to be vertically adjustable.

15. The assembly of claim 12, further comprising a roller assembly mounted to an end of said upwardly extending member, wherein said roller assembly rollably engages with said track section to provide moving engagement therebetween.

16. A support assembly for use with a piece of furniture having a first surface and a front side comprising:

a support frame positioned on the floor having at least one upwardly extending member;

an upper body support apparatus having at least one armrest that is supported adjacent said front side of said piece of furniture, wherein said upper body support apparatus provides support for at least a portion of said user's upper body when said user is positioned adjacent said front side of said piece of furniture and is using at least one hand to engage in manual activities on a work surface positioned adjacent said support apparatus, wherein said upper body support apparatus is movable relative said piece of furniture between a first position, wherein said armrest is supported by said support frame adjacent a front side of said piece of furniture, and a second position wherein said upper body support apparatus is supported by said support frame so as to be stored underneath said piece of furniture and wherein said upper body support apparatus is mounted on said at least one upwardly extending member of said support frame; and wherein said support frame includes a track section and said at least one upwardly extending member is movably engaged with said track section so that said upper body support apparatus can be moved between said first and said second positions.

17. The assembly of claim 16, further comprising a counter-balance member that is coupled to said support frame, wherein said counter-balance member is dimensioned to bear against said first surface of said piece of furniture so that said piece of furniture reduces the tendency of said assembly to tip as a result of said user making use of said upper body support apparatus.

18. The assembly of claim 17, wherein said support frame is positioned substantially underneath a surface of said piece of furniture and said counter-balance member is positioned adjacent said lower surface.

19. The assembly of claim 18, further comprising at least one stop assembly, which includes a stop, mounted on said counter-balance member wherein said stop assembly is adjustable so that said stop can be positioned in contact with said lower surface of said piece of furniture.

20. The assembly of claim 19, wherein said counter-balance member is adjustably coupled to said support frame so as to be vertically adjustable relative to said floor.

21. The assembly of claim 17, wherein said at least one armrest comprises two armrests that are coupled to said subframe so that said armrests are horizontally adjustable by said user.

22. The assembly of claim 21, wherein said two armrests are pivotally connected to said subframe so that said armrests can be positioned either in a support position wherein said armrests extend generally horizontally and thereby support said user's arm or in a storage configuration wherein said at least one armrest is positioned generally vertically.

23. The assembly of claim 22, wherein said piece of furniture has a substantially horizontal surface and said assembly is positioned so that said armrests are positioned adjacent an edge of said horizontal surface.

24. The assembly of claim 16, further comprising a work platform mounted on said support apparatus.

25. The assembly of claim 24, wherein said work platform is configured to receive a keyboard.

26. The assembly of claim 25, further comprising a roller assembly mounted to an end of said at least one upwardly extending member wherein said roller assembly rollably engages with said track section to provide moving engagement therebetween.

* * * * *